US008499474B2

(12) United States Patent
Kaufman

(10) Patent No.: US 8,499,474 B2
(45) Date of Patent: Aug. 6, 2013

(54) HANDS-FREE STEP-IN CLOSURE APPARATUS

(76) Inventor: Steven Kaufman, New York, NY (US)

( * ) Notice: Subject to any disclaimer, the term of this patent is extended or adjusted under 35 U.S.C. 154(b) by 422 days.

(21) Appl. No.: 12/877,605

(22) Filed: Sep. 8, 2010

(65) Prior Publication Data

US 2011/0146106 A1 Jun. 23, 2011

Related U.S. Application Data

(63) Continuation-in-part of application No. 12/172,609, filed on Jul. 14, 2008, now Pat. No. 8,065,819.

(60) Provisional application No. 61/068,145, filed on Mar. 5, 2008.

(51) Int. Cl.
*A43B 5/00* (2006.01)
*A43C 11/00* (2006.01)

(52) U.S. Cl.
USPC ..... 36/50.1; 36/138; 36/58.5

(58) Field of Classification Search
USPC ..... 36/50.1, 58.5, 58.6, 138, 50.5, 105
See application file for complete search history.

(56) References Cited

U.S. PATENT DOCUMENTS

| | | | | | |
|---|---|---|---|---|---|
| 1,081,678 | A | * | 12/1913 | Langerak | 36/138 |
| 2,069,752 | A | * | 2/1937 | Dorr | 36/11.5 |
| 2,450,250 | A | * | 9/1948 | Napton | 36/103 |
| 2,452,649 | A | * | 11/1948 | Graves | 36/138 |
| 3,146,535 | A | * | 9/1964 | Owings | 36/7.3 |
| 3,192,651 | A | * | 7/1965 | Smith | 36/105 |
| 4,403,790 | A | | 9/1983 | Bauer et al. | |
| 4,429,896 | A | | 2/1984 | Spademan | |
| 4,907,352 | A | | 3/1990 | Ginsberg | |
| 5,054,216 | A | | 10/1991 | Lin | |
| 5,184,410 | A | * | 2/1993 | Hamilton | 36/105 |
| 5,282,327 | A | * | 2/1994 | Ogle | 36/138 |
| 5,362,087 | A | | 11/1994 | Agid | |
| 5,481,814 | A | * | 1/1996 | Spencer | 36/138 |

(Continued)

FOREIGN PATENT DOCUMENTS

| | | |
|---|---|---|
| EP | 1059044 | 12/2000 |
| EP | 1593315 | 5/2008 |

OTHER PUBLICATIONS

International Search Report and Written Opinion of the International Searching Authority mailed by the U.S. Receiving Office on Sep. 1, 2009 for co-pending International Appl. No. PCT/US 09/49946.

*Primary Examiner* — Marie Patterson
(74) *Attorney, Agent, or Firm* — Leason Ellis LLP

(57) ABSTRACT

A hands-free fastening mechanism for releasably securing a user's foot to footwear is disclosed. The fastening mechanism comprises at least one pivotable strap which is coupled to a hinge mechanism which, in turn, is secured to the footwear. The hinge mechanism allows the strap to pivot between an open and a closed position. The strap is further coupled to a lever which is engageable by a user's foot so as to cause the strap to move from the open position to the closed position. When the strap moves to the closed position, a catch will engage, thereby securing the user's foot within the footwear. The footwear may then be removed by using the other foot to apply pressure to a protruding member or by striking the heel on a hard surface and then withdrawing the secured foot such that the catch is disengaged and the foot is released.

32 Claims, 14 Drawing Sheets

U.S. PATENT DOCUMENTS

| | | | | |
|---|---|---|---|---|
| 5,722,680 | A | 3/1998 | Dodge | |
| 5,779,259 | A | 7/1998 | Lin | |
| 5,941,555 | A | 8/1999 | Dodge | |
| 5,954,358 | A | 9/1999 | Bejean et al. | |
| 5,983,530 | A | 11/1999 | Chou | |
| 6,018,890 | A | 2/2000 | Bowen | |
| 6,189,239 | B1 * | 2/2001 | Gasparovic et al. | 36/102 |
| 6,427,361 | B1 | 8/2002 | Chou | |
| 6,575,489 | B1 | 6/2003 | White | |
| 6,594,921 | B2 * | 7/2003 | Laio et al. | 36/138 |
| 6,643,954 | B2 | 11/2003 | Voswinkel | |
| 6,684,534 | B2 | 2/2004 | Dodge | |
| 6,880,270 | B2 | 4/2005 | Prather | |
| 6,983,952 | B2 | 1/2006 | Golling | |
| 7,047,673 | B2 | 5/2006 | Dodge | |
| 7,059,069 | B2 * | 6/2006 | Raluy et al. | 36/105 |
| 7,178,270 | B2 * | 2/2007 | Hurd et al. | 36/92 |
| 7,730,639 | B2 * | 6/2010 | Hurd et al. | 36/92 |
| 7,793,438 | B1 * | 9/2010 | Busse et al. | 36/105 |
| 8,209,886 | B2 * | 7/2012 | Hurd et al. | 36/92 |
| 2005/0198867 | A1 | 9/2005 | Labbe | |
| 2007/0152426 | A1 | 7/2007 | Resch et al. | |
| 2007/0209234 | A1 | 9/2007 | Chou | |

* cited by examiner

HANDS-FREE STEP-IN CLOSURE APPARATUS

CROSS-REFERENCE TO RELATED APPLICATIONS

This application is a continuation-in-part of U.S. patent application Ser. No. 12/172,609 filed Jul. 14, 2008, which claims priority under 35 U.S.C. §119(e) to U.S. Provisional Patent Application No. 61/068,145 filed on Mar. 5, 2008, the entirety of all of which are herein incorporated by reference.

BACKGROUND

1. Field of the Disclosure

This disclosure relates generally to the field of foot bindings. In particular, the present disclosure relates to a hands-free mechanism suitable for securing and releasing an article about a user's foot.

2. Description of the Related Art

Over the course of human history there has been a continuing and ever-present need to utilize various types of footwear suitable for differing purposes. For example, athletic shoes typically comprise a rubber sole combined with a lightweight, breathable mesh upper; work boots are frequently made of a tough rubber sole, leather upper, and are reinforced with a steel toe; and sandals have an open-toe design, consisting merely of some form of sole accompanied by straps to secure the sole to the user's foot. No matter its design or intended purpose, any footwear must include a manner of securely fastening or binding the article to the foot.

A number of fastening devices and methods are presently utilized with the preferred manner of securing the various types of footwear to the user's feet being dependent on the specific application, environmental considerations, the user's preferences, and the physical capabilities of the user. Traditional securing mechanisms include the utilization of shoelaces, zippers, Velcro, buttons, hook and loop fasteners, snaps, and ropes. However, each of these fasteners typically requires the use of one's hands for efficient operation.

The process of securing footwear to the user's feet also requires a certain degree of dexterity, physical maneuverability, and flexibility. This may pose a problem for individuals who are physically challenged such as the elderly, handicapped, or disabled. Furthermore, there exists a desire for persons of ordinary ability to be able to quickly and easily fasten and/or unfasten footwear by means of hands-free operation. Such capability may be desirable merely for convenience, for use in emergency situations, or under hazardous conditions.

SUMMARY

In view of the above-described problems, it is an object of the present disclosure to provide a means of quickly and securely fastening footwear to a user's feet via a simple, reversible, and hands-free operating mechanism. This is accomplished by a fastening device which secures and releases a pivotally movable strap by means of a simple stepping motion of the user's foot. Such a device is advantageous in terms of ease of use, speed of insertion/removal of the foot, and availability of hands-free operation.

In one embodiment, these advantages are realized by means of a foot fastening device configured for use with an article of footwear. The foot fastening device comprises a pair of pivotally movable straps and a pair of movable levers. Each lever is coupled to one of the straps and is engageable by a part of a foot so as to cause the straps to move from an open position to a closed position when engaged by the part of the foot. At least one catch on at least one of the straps in the pair is positioned to releasably connect the pair of straps together.

Another embodiment relates to an article for use with footwear comprising a sole and a foot fastening device coupled to the sole. The foot fastening device comprises at least one pivotally movable strap and a support bracket coupled to the strap to allow the strap to move between a first position and a second position. A movable lever is coupled to the strap, being positioned relative to the sole such that when engaged by a part of a foot, it will cause the strap to move from the first position to the second position. At least one catch is affixed to at least one strap such that, when the catch is engaged, the foot is restrained within the footwear and, when the catch is disengaged, the foot can be removed from the footwear.

An additional embodiment relates to a foot fastening device configured to be attached to an article of footwear. The fastening device comprises at least one pivotally movable strap and a support bracket coupled to the pivotally movable strap to allow the strap to move between a first position and a second position. A movable lever is also coupled to the strap and positioned such that when engaged by a part of a foot it will cause the strap to move from the first position to the second position. At least one catch is affixed to at least one strap such that, when the catch is engaged, the foot is restrained within the footwear and, when the catch is disengaged, the foot can be removed from the footwear.

Still another embodiment relates to a fastening device comprising pivotally movable straps capable of moving between an open and closed position by rotating about an axis located between an upper and lower portion of the strap. The straps are attached to horizontally oriented hinge rods located at opposite ends of a U-shaped support bracket positioned within the footwear. The straps are able to rotate a minimum of 90° such that when a user's foot steps into and thereby rotates the lower portions downward, the upper portions rotate upwards and inwards such that their distal ends engage with each other above the user's mid-foot and secure the foot within the footwear. The foot may then be removed by immobilizing the footwear and then lifting up on the foot to disengage the straps such that the distal ends of the upper portions rotate outwards, thereby releasing the foot.

Yet another embodiment relates to a fastening device wherein the straps comprise upper and lower portions which pivot about a vertical axis. The straps are attached to vertically oriented hinge rods which are located at opposite ends of a U-shaped support bracket positioned within the footwear. The user engages the straps and secures the footwear by moving the foot forwards such that the lower portions rotate forwards while the upper portions rotate backwards and inwards such that their distal ends engage with each other behind the Achilles tendon of the foot and securely fasten the user's foot within the footwear. The user's foot may then be removed by immobilizing the footwear and then moving the foot backwards to disengage the straps such that the distal ends of the upper portions rotate outwards, thereby releasing the foot.

A further embodiment relates to a fastening device wherein the straps are affixed by means of hinge rods to support brackets which are built directly into the footwear. The straps may be removed from the footwear by disengaging the hinge rods.

Another embodiment relates to a hands-free fastening device which reversibly secures the footwear by means of a catch which engages by way of permanent magnets with opposing polarities or a mechanical interlocking device.

An additional embodiment relates to a hands-free fastening device wherein when the straps are not engaged they are maintained in the open position by means of a spring or elastic member.

A further embodiment relates to a hands-free fastening device wherein a user's foot steps down onto a hinged in-sole which in-turn engages a movable lever that will cause the strap to move from the first position to the second position.

Another embodiment relates to a fastening device configured for use with an article of footwear comprising a pivotally movable heel enclosure comprising a heel cup which is configured to surround a heel and secure behind an Achilles tendon of a foot, and a heel base which is coupled to the heel cup and is engageable by a part of a foot so as to cause the heel enclosure to move from an open position to a closed position when engaged by the part of the foot. The fastening device further comprises a guide having a pair of uprights along with a pair of connectors, each of which is coupled to one of the uprights at one end and a side of the heel cup at the other end and are each configured to guide the heel enclosure between an open position and a closed position.

In some embodiments the pivotally movable heel enclosure is affixed to a hinge mount by means of a hinge which is configured to allow the heel enclosure to move between the open position and the closed position. The hinge may comprise at least one catch which, when engaged, will maintain the heel enclosure in the closed position and, when disengaged, will permit the heel enclosure to rotate to the open position. In some embodiments the heel enclosure is maintained in the open position by means of a torsion spring. The catch may comprise at least one of a permanent magnet or a mechanical interlocking device and the permanent magnet may be removable. An attractive force of the permanent magnet may be adjusted by changing the gap distance between opposing hinge leaves of the hinge. In some embodiments the gap distance is changed by means of a shim or a washer.

Each upright may also comprise a clevis which permits the connector coupled to each upright to slide through their respective clevis along a predetermined path. Each connector may also comprise a slot and is slidably attached within the clevis of its respective upright by means of an attachment point which passes through its respective slot.

Still another embodiment relates to an article of footwear comprising a sole, a pivotally movable heel enclosure comprising a heel cup which is configured to surround a heel and secure behind an Achilles tendon of a foot, and a heel base which is coupled to the heel cup and is engageable by a part of a foot so as to cause the heel enclosure to move from an open position to a closed position when engaged by the part of the foot. The article of footwear may also comprise a hinge which is coupled to the heel enclosure to allow the heel enclosure to move between the open position and the closed position, a guide having a pair of uprights, as well as a pair of connectors, each of which is coupled to one of the uprights at one end and a side of the heel cup at the other end and are each configured to guide the heel enclosure between an open position and a closed position.

In some embodiments the hinge is affixed to a hinge mount. The hinge mount may be provided within a first cavity in the sole. In still another embodiment the hinge comprises at least one catch which, when engaged, will maintain the heel enclosure in the closed position and, when disengaged, will permit the heel enclosure to rotate to the open position. The heel enclosure may be maintained in the open position by means of a torsion spring while the catch may be at least one of a permanent magnet or a mechanical interlocking device.

In still other embodiments, the guide is provided within a second cavity in the sole and the uprights are embedded within an upper of the footwear. Each upright may comprise a clevis which permits the connector coupled to each upright to slide through their respective clevis along a predetermined path. In a particular embodiment each connector also comprises a slot and is slidably attached within the clevis of its respective upright by means of an attachment point which passes through its respective slot.

The article of footwear may also comprise a flexible in-sole positioned to engage the heel base. In some embodiments the in-sole comprises a semi-rigid board layer affixed to an underside of the in-sole in a region where the in-sole engages the heel base.

In another embodiment, a foot fastening device configured for use with an article of footwear comprising a pivotally movable strap which is configured to surround a heel and secure behind an Achilles tendon of a foot, and a lever which is coupled to the strap and is engageable by a part of a foot so as to cause the strap to move from an open position to a closed position when engaged by the part of the foot is disclosed. The foot fastening device further comprises a guide having a pair of uprights, and a pair of connectors, each of which is coupled to one of the uprights at one end and a side of the strap at the other end and are each configured to guide the strap between an open position and a closed position.

In some embodiments the strap and lever are affixed to a hinge mount by means of a hinge which is configured to allow the strap to move between the open position and the closed position. The hinge may comprise at least one catch which, when engaged, will maintain the strap in the closed position and, when disengaged, will permit the strap to rotate to the open position. The catch may be, for example, at least one of a permanent magnet or a mechanical interlocking device. When a permanent magnet is used as the catch, it may be removable. In other embodiments, each upright comprises a clevis which permits the connector coupled to each upright to slide through their respective clevis along a predetermined path. In some embodiments, each connector comprises a slot and is slidably attached within the clevis of its respective upright by means of an attachment point which passes through its respective slot.

Yet another embodiment relates to footwear comprising multiple hands-free fastening devices to more securely attach the footwear to the user's foot.

DETAILED DESCRIPTION

Figure 1A:
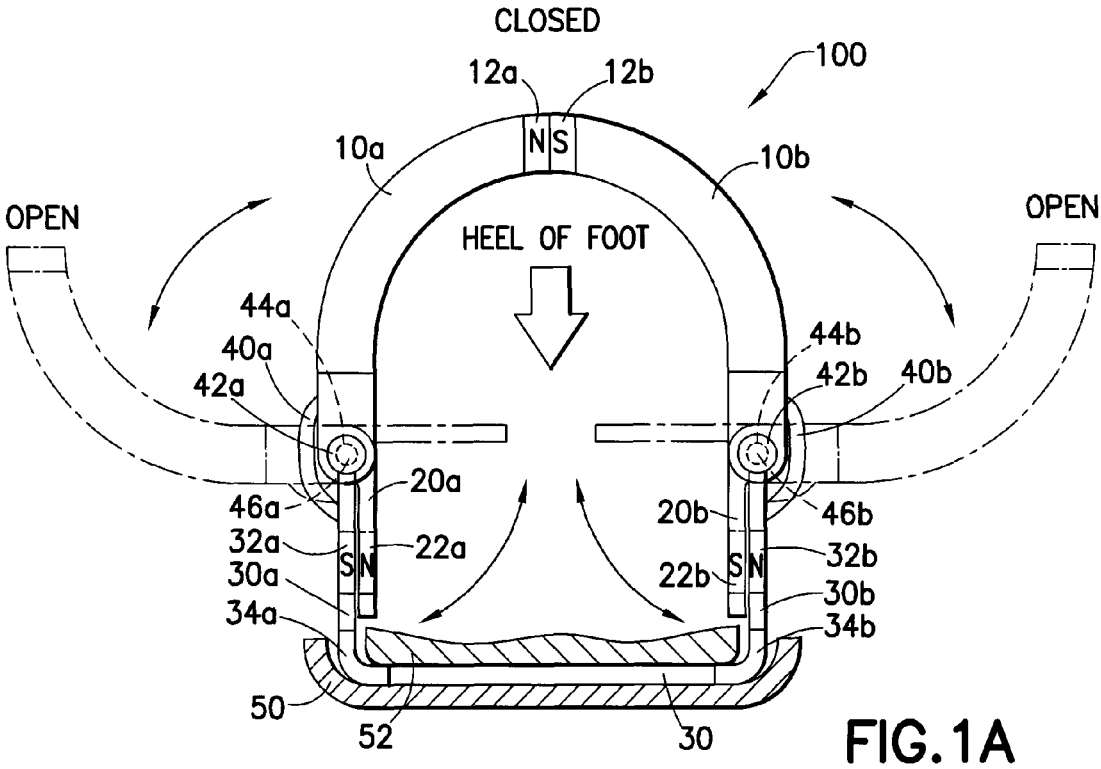
FIG. 1A is a cross-sectional schematic showing a rear view of a first embodiment of the fastening device which illustrates the basic mode of operation.

The above and other objectives of the disclosure will become more apparent from the following description and illustrative embodiments which are described in detail with reference to the accompanying drawings. Similar elements in each figure are designated by like reference numbers and, hence, subsequent detailed descriptions thereof may be omitted for brevity.

The present disclosure is directed to a hands-free step-in closure apparatus for shoes. Thus, as the name implies, this apparatus is capable of securing and releasing footwear to a user's foot by an operating mechanism which can be engaged and disengaged without the use of one's hands. The general operative concept is the utilization of a strap which pivots between an open and closed position by rotating about a hinge in response to the application of a force to a lever. Since this is a hands-free mechanism, the force required to activate the lever is generally applied using one's foot. The lever itself is coupled to the strap such that when the lever is moved the strap also moves. By applying a force to the lever, the strap is moved along a path which puts it in a position to secure the user's foot to the footwear.

In securing the foot it is also necessary to have some type of catch which engages and remains engaged with sufficient force to maintain the footwear on the user's foot amidst its normal use. Even so, the catch should not be of such strength that it cannot be disengaged without the use of one's hands. Therefore the catch may take the form of oppositely aligned permanent magnets of appropriate strength or may be some form of mechanical interlocking device. The catch itself may also be of adjustable strength to enable the user to vary the force required to remove the footwear. This may be accomplished, for example, by configuring the device such that the magnets can be replaced with others with lesser or greater strength.

When the footwear is not in use the fastening device may be such that it is maintained in an open position, thereby allowing quick and easy access to a user who may desire to literally jump into the footwear. The strap and lever may be maintained in an open position by any of a number of spring mechanisms which are well-known in the art. The strength of the spring must be such that the straps remain open and the levers are in a position to be engaged by the user, yet they should not be so strong as to require undue exertion on the part of the user in order to fasten the shoes to the user's feet. The spring mechanism also should not be such that it opposes the holding strength of the mechanical interlocking device to such an extent that it significantly weakens its securing power. If, however, the fastening device is maintained in a closed position when not in use, the user may first disengage the straps and then engage the straps again in the manner as described above.

The various articles which constitute the fastening device including the straps, support brackets, hinge assembly, and levers should be constructed of material sturdy enough to perform the desired operation while withstanding normal wear and maintaining the comfort of the user. Thus, the strap, hinge, and lever may each be constructed from, but are not limited to a polymer, metal, metal alloy, or composite material depending on the specific combination of features desired. Furthermore, the operating mechanism should be simple to facilitate ease of use, yet robust enough to endure repetitive movement between an open and closed position.

The above general description provides an overall picture of the operation of the fastening device. The scope of the device's functionality will become clearer upon consideration of the following illustrative embodiments which, when taken in conjunction with FIGS. 1-12, explain the operating principle in greater detail.

First Embodiment

FIG. 1A is a schematic showing a rear view of a first embodiment of a fastening device 100. The fastening device 100 shown in FIG. 1A comprises two straps 10*a* and 10*b* which are positioned on the left and right side of the user's foot, respectively. The straps are individually affixed to left 20*a* and right 20*b* levers which are, in turn, secured to corresponding left 30*a* and right 30*b* arms of a support bracket 30 (which, in this embodiment, is U-shaped) by means of a hinge rod (46*a* and 46*b* which passes through a hinge located on each lever. The hinge rods are, in turn, secured to the support bracket by attachment points located on the end of each arm of the support bracket. Thus lever 20*a* is attached to arm 30*a* by hinge rod 46*a* which passes through hinge 44*a* and is secured at attachment points 42*a*. Likewise, lever 20*b* is attached to arm 30*b* by hinge rod 46*b* which passes through hinge 44*b* and is secured at attachment points 42*b*.

The combined strap/lever components (10*a*-20*a* and 10*b*-20*b*) rotate about their respective hinge rod (46*a* and 46*b*) when a force is applied to the levers. The hinge rods 46*a* and 46*b* are positioned such that they are approximately parallel with the base of the support bracket 30 (i.e., oriented approximately horizontal with respect to the ground). The spatial alignment between each strap and its corresponding lever is such that a rotation of approximately 90° between a closed (dark lines) and open (dotted lines) position is permitted. When in the open position the levers 20*a* and 20*b* are approximately parallel with the plane formed by the base of the support bracket 30 whereas in the closed position the levers 20*a* and 20*b* are approximately perpendicular with the plane formed by the base of the support bracket 30. Furthermore, when in the closed position, the levers 20*a* and 20*b* are approximately parallel with the arms 30*a* and 30*b* of the support bracket and the distal ends of the straps 10*a* and 10*b* come into contact with each other.

Straps 10*a* and 10*b* and their corresponding lever 20*a* and 20*b* are each equipped with a permanent magnet at their distal ends. Thus, the left 10*a* and right 10*b* straps have magnets 12*a* and 12*b*, respectively, situated at their distal ends. Likewise, levers 20*a* and 20*b* have magnets 22*a* and 22*b*, respectively, positioned at their distal ends. The support bracket 30 further comprises permanent magnets 32*a* and 32*b* positioned approximately midway along arms 30*a* and 30*b*, respectively, such that they are horizontally aligned with corresponding magnet 22*a* on the left lever 20*a* and 22*b* on the right lever 20*b* when the device is in its closed position.

The fastening device 100 therefore comprises three sets of mating magnets, namely 32*a*-22*a*, 12*a*-12*b*, and 22*b*-32*b*. Each set is designed such that they have opposing polarities on a mating side, thereby generating an attractive force capable of holding the straps together when in the closed position. When the magnets are disengaged, straps 10*a* and 10*b* are maintained in the open position by means of elongated elastic members 40*a* and 40*b*. As illustrated in FIG. 1A, elastic member 40*a* has one end attached to the outside of arm 30*a* on the left side of the support bracket 30 with the other end attached to the bottom of the left strap 10*a*. Elastic member 40*b* is attached in a similar manner on the right side. The length and elasticity of the elastic members 40*a* and 40*b* are such that when the magnets are disengaged sufficient tensile force is applied to pull the straps 10*a* and 10*b* apart and maintain them in an open position.

Figure 1B:
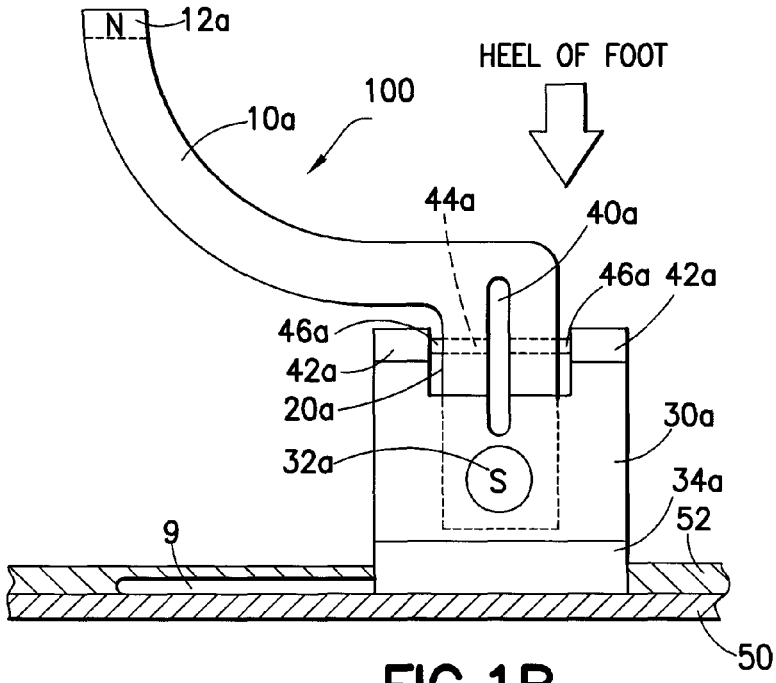
FIG. 1B is a schematic showing a side view of the first embodiment with the straps in a closed position.

A side view of the fastening device 100 is shown in FIG. 1B which illustrates that the support bracket 30 comprises a forward-facing lip 9 which extends from the bottom section of the support bracket 30, provides additional stability, and helps to counteract the force exerted on straps 10*a* and 10*b* upon disengaging the magnets. The lip 9 as well as the bottom section of the support bracket 30 does not have to be a continuous surface connecting the left side 30*a* of support bracket 30 to the right side 30*b* as depicted in FIG. 1B. Instead, it is possible that the lip 9 as well as the bottom section of the support bracket 30 only extend on each side to some distance less than halfway along the width of the sole, thereby resulting in the left side 30*a* and right side 30*b* as being two independent structural entities. This would enable the shoe manufacturer utilizing the fastening device 100 to produce the same support bracket 30 components regardless of the shoe width size, thereby affecting reduced manufacturing costs. The lip 9, along with the bottom section of the support bracket 30, is typically sandwiched between the inner sole 52 and mid-sole 50 of the footwear, thereby maintaining the arms 30*a* and 30*b* of the support bracket in an upright position. A recessed portion may be pre-formed within the linings of the footwear such that the support bracket 30 is embedded within this "pocket" in order to precisely and securely position the support bracket 30 in the footwear. Such a design facilitates ease of manufacture and provides for improved comfort of the user. The support bracket 30 itself may be made of any material of suitable rigidity and mechanical strength such as a polymer, metal, metal alloy, or composite material. The left 34*a* and right 34*b* corners of the support bracket are preferably constructed of a material of sufficient rigidity, yet with enough elasticity to deform appreciably under application of an external force while still returning to its original shape once the force is removed.

Figure 2:
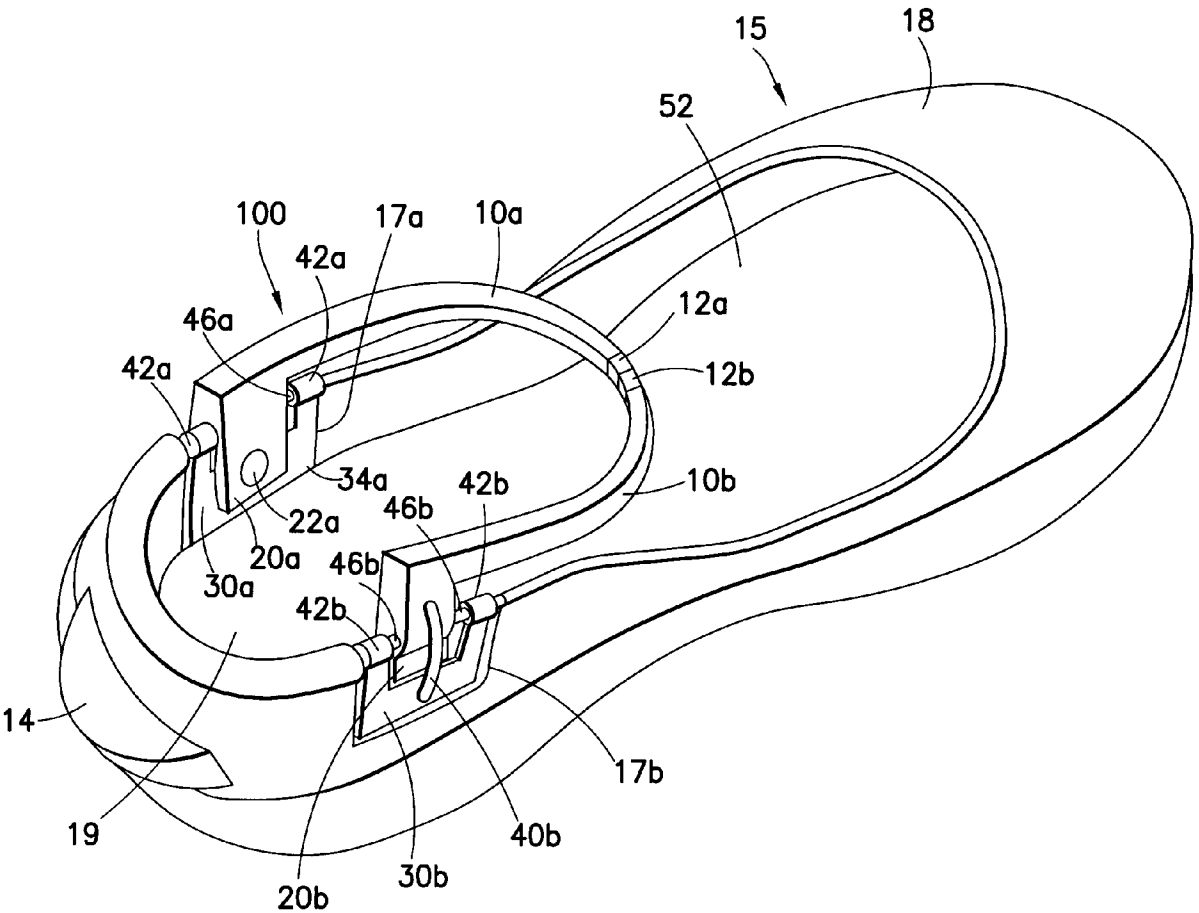
FIG. 2 is an illustration showing a perspective view of an actual shoe which incorporates the first embodiment of the fastening device.

A method of operating the hands-free fastening device will now be described with reference to FIG. 2 which shows an actual implementation of the fastening device 100 of FIGS. 1A-B within footwear 15. In the embodiment as shown, the footwear 15 has been designed such that cutout portions 17*a* and 17*b* accommodate operation of the fastening device 100. When the shoe is not in use, the fastening device 100 is normally maintained in an open position (dotted lines in FIG. 1A) by means of elastic members 40*a* and 40*b*, thereby permitting ease of inserting the user's foot. The footwear may be secured to the user's foot by means of a simple downward stepping motion.

This is accomplished by first having the user slide his/her toes into the front end 18 and then by bringing the heel of the foot down towards the base 19 of the footwear such that it comes into contact with and engages levers 20*a* and 20*b*. Continued downward pressure causes the levers 20*a* and 20*b* to move pivotally downwards about their respective hinge rods 46*a* and 46*b* while the straps 10*a* and 10*b* pivot upwards. Thus, when viewed from the rear (e.g., FIG. 1A), the left strap 10*a* and lever 20*a* rotate clockwise about hinge rod 46*a* whereas the right strap 10*b* and right lever 20*b* rotate counterclockwise about hinge rod 46*b*. Once the foot has traveled a sufficient distance downwards the three sets of mating magnets 32*a*-22*a*, 12*a*-12*b*, and 22*b*-32*b* will come into sufficient proximity with each other that there is an attractive force between each set of magnets of sufficient strength to snap the fastening mechanism 100 into the closed position, thereby securing the footwear to the user's foot.

The fastening mechanism 100 may be disengaged by performing the reverse of the above process. However, in this case, it may be necessary to immobilize the footwear such that it is not lifted up along with the foot and sufficient force can be applied to disengage straps 10*a* and 10*b*. This may be accomplished by using the opposing foot to press down on the heel of the footwear, thereby immobilizing it. The act of temporarily immobilizing the footwear at the heel may be facilitated by incorporation of a protruding member 14 which is securely fastened to or in the vicinity of the heel of the footwear, thereby providing a surface by which to immobilize the shoe. The straps 10*a* and 10*b* can be disengaged by lifting up the heel of the foot positioned in the footwear such that the attractive holding force between each of the magnet pairs 32*a*-22*a*, 12*a*-12*b*, and 22*b*-32*b* is broken and the straps 10*a* and 10*b* rotate outwards, thereby permitting the foot to be removed.

In a second hands-free method of releasing a user's feet from the apparatus 100, the user may apply a downward pressure to the ball of the foot to be released while simultaneously raising the heel. The user then applies a twisting motion to rotate the ankle such that pressure is applied to straps 10*a* and 10*b* in an amount sufficient to disengage the magnets and pull the foot upwards and out of the fastening mechanism.

Second Embodiment

Figure 3A:
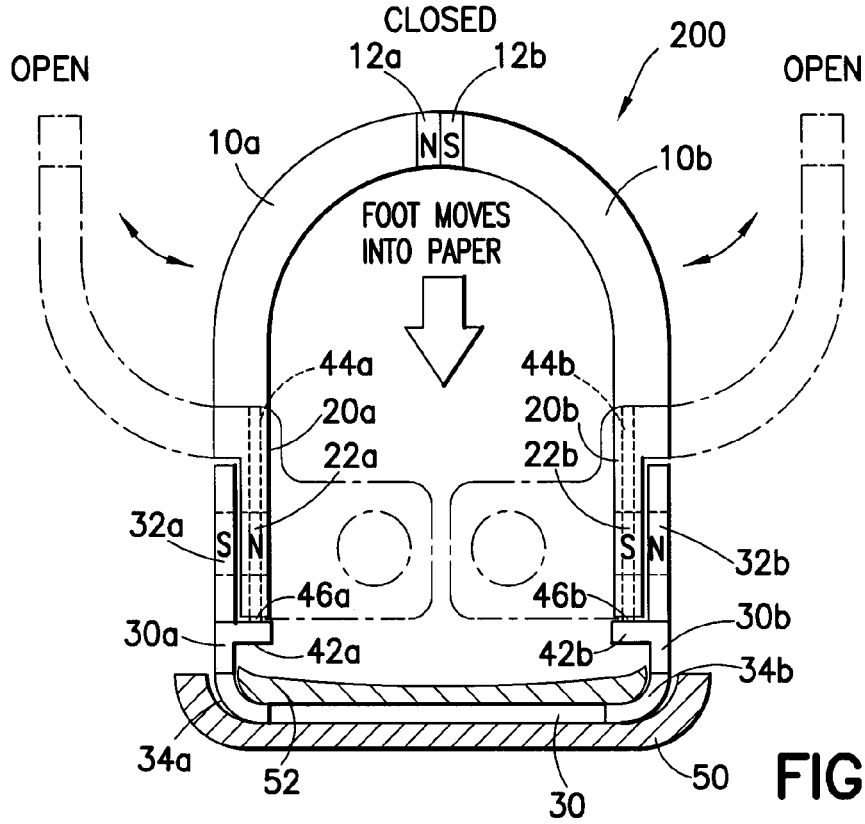
FIG. 3A is a cross-sectional schematic showing a rear view of a second embodiment of the fastening device which illustrates the basic mode of operation.

A second embodiment of the fastening device 200 will now be described in detail with reference to FIGS. 3A and 3B. The underlying principles governing operation of the second embodiment are similar to those presented above for the first embodiment, but the mechanics differ. Here, the hinge rods 46*a* and 46*b* are aligned approximately perpendicular instead of approximately parallel to the base of the support bracket 30 and the user's foot engages the levers by sliding forward instead of stepping downwards.

The fastening device 200 comprises components analogous to those disclosed for the fastening device 100 of the first embodiment. FIG. 3A is a rear view of the fastening device 200 showing the inclusion of left 10*a* and right 10*b* straps with corresponding left 20*a* and right 20*b* levers. The straps 10*a* and 10*b* are respectively secured to the left 30*a* and right 30*b* arms of support bracket 30 by means of hinge rods 46*a* and 46*b* which pass through hinges 44*a* and 44*b* and are secured at attachment points 42*a* and 42*b* located on the left 30*a* and right 30*b* arm, respectively.

The hinge rods are aligned approximately perpendicular to the base of the support bracket 30 (i.e., oriented approximately vertical with respect to the ground), thereby permitting the straps 10*a* and 10*b* to rotate between a closed (dark lines) and open (dotted lines) position. As shown by FIG. 3B, when in the closed position, the levers 20*a* and 20*b* are approximately parallel to each other and to the arms of the support bracket, 30*a* and 30*b*. Levers 20*a* and 20*b* are oriented at an angle with respect to the straps 10*a* and 10*b* (as viewed from above) such that when the foot is fully inserted into the footwear (i.e., the fastening device 200 is in the closed position) the straps 10*a* and 10*b* are fully engaged behind the Achilles tendon of the foot.

As is the case for the first embodiment, each strap and its corresponding lever comprise permanent magnets 12*a*-12*b*, and 22*a*-22*b* which are positioned at the distal ends of each individual strap and lever, respectively. The support bracket 30 further comprises permanent magnets 32*a* and 32*b* positioned approximately midway along the left 30*a* and right 30*b* arms of the support bracket, respectively, such that they are aligned with corresponding magnet 22*a* on the left 20*a* lever and magnet 22*b* on the right 20*b* lever when in the closed position. The fastening device 200 is therefore comprised of three sets of mating magnets positioned such that they have opposing polarities on a mating side. When the magnets are disengaged, the straps are maintained in the open position by any of a number of suitable means. This may be by a type of spring mechanism or by means of elongated elastic members as utilized in the first embodiment. The elasticity of the spring mechanism may be adjusted such that when the magnets are disengaged sufficient tensile force is applied to pull straps 10*a* and 10*b* apart and maintain them in the open position.

Figure 3B:
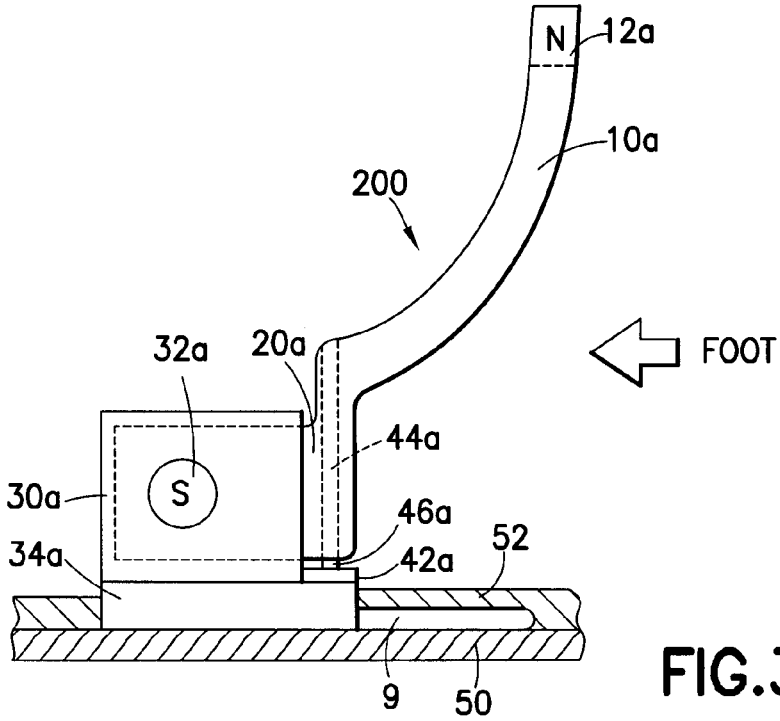
FIG. 3B is a schematic showing a side view of the second embodiment with the straps in a closed position.

A side view of the fastening device 200 is shown in FIG. 3B which illustrates that the support bracket 30 comprises a rear-facing lip 9 which extends from the bottom section of the support bracket 30. In this embodiment a rear-facing lip 9 is used in order to counteract the force exerted on rearward facing straps 10*a* and 10*b* upon disengaging the magnets. In a manner identical to the first embodiment, the lip 9 and bottom section of the support bracket 30 may be sandwiched between the inner sole 52 and mid-sole 50 of the footwear, thereby maintaining the position of arms 30*a* and 30*b*. Also in a manner identical to the first embodiment and for the same reasons, the lip 9 and bottom section of the support bracket 30 may be split into two parts, thereby resulting in left support bracket 30*a* and right support bracket 30*b* being two independent structural entities.

A method of operating the second embodiment of the hands-free fastening device will now be described. In this embodiment the footwear is secured to the user's foot by means of a simple forward stepping motion. This is accomplished by merely having the user slide his/her toes into the footwear from the rear (see, e.g., FIG. 3A) such that the foot comes into contact with and engages the left 20*a* and right 20*b* levers. Continued forward pressure causes the levers to pivotally rotate forward about hinge rods 46*a* and 46*b* while the straps 10*a* and 10*b* rotate backwards. In this manner, when viewed from above, strap 10*a* and lever 20*a* rotate counterclockwise about hinge rod 46*a* whereas strap 10*b* and lever 20*b* rotate clockwise about hinge rod 46*b*. Once the foot has traveled a sufficient distance forward the three sets of mating magnets 32*a*-22*a*, 12*a*-12*b*, and 22*b*-32*b* will come into sufficient proximity with each other that there is an attractive force between each set of magnets of sufficient strength to snap the fastening device 200 into the closed position. In the second embodiment, the straps 10*a*-10*b* engage behind the user's ankle and above the heel in the vicinity of the Achilles tendon.

The fastening device 200 may be disengaged by performing the reverse of the above process. It will again be necessary to immobilize the footwear such that it does not move along with the foot and sufficient force can be applied to disengage straps 10*a* and 10*b*. This may be accomplished by pressing down on the sole of the footwear such that friction between the bottom of the sole and the ground does not allow the footwear to move. The act of immobilizing the footwear may be facilitated by using the other foot to block the footwear from sliding across the ground. The straps 10*a* and 10*b* can be disengaged by sliding the foot positioned in the footwear fully backwards such that the attractive holding force between each of the magnet pairs 32*a*-22*a*, 12*a*-12*b*, and 22*b*-32*b* is broken and the straps 10*a* and 10*b* rotate outwards, thereby permitting the foot to be removed.

Third Embodiment

Figure 4:
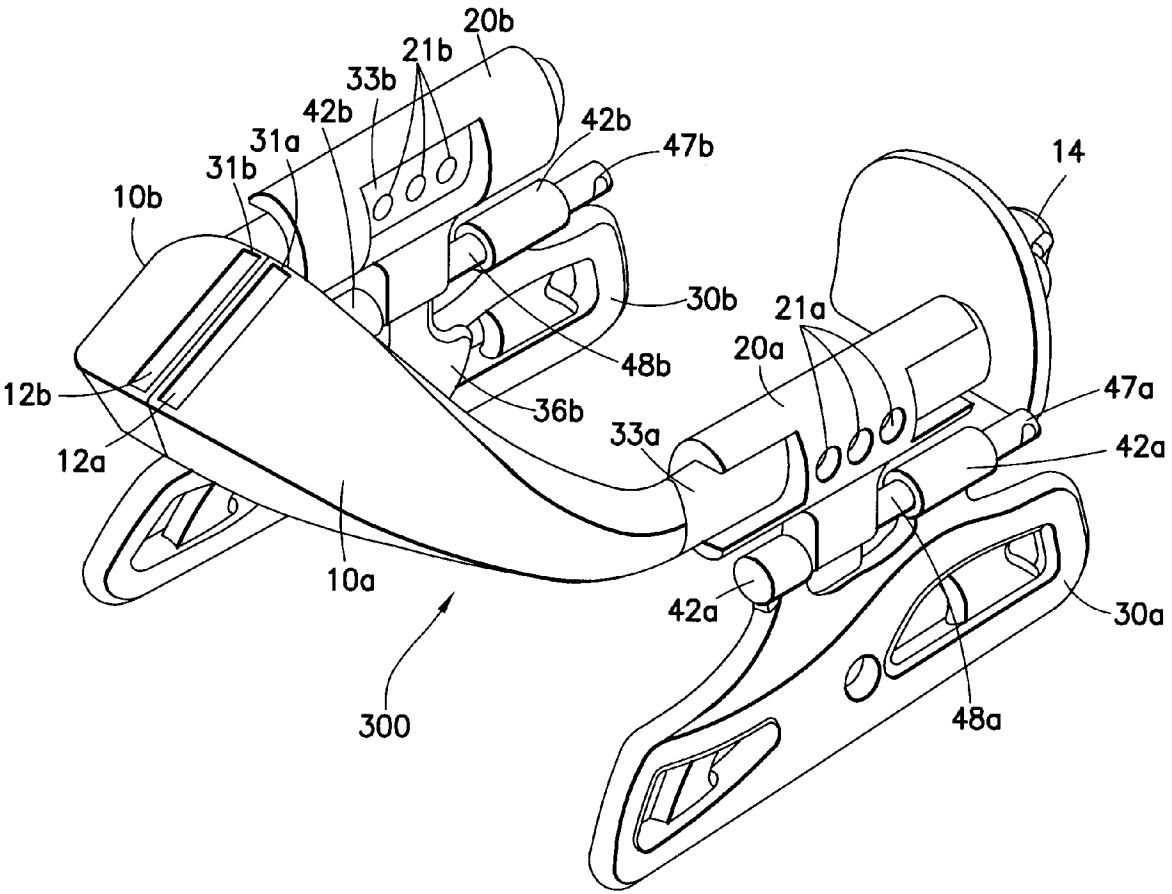
FIG. 4 is a perspective view of a third embodiment of the fastening device which is designed to be built directly into the shoe during manufacture.

A front perspective view of a schematic illustrating a third embodiment of the fastening device 300 is provided in FIG. 4. The fastening device 300 comprises a structure and operating mechanism similar to that provided in the first embodiment, but includes a number of additional design features. For instance, each strap 10*a* and 10*b* is attached to, but physically separate from the left 20*a* and right 20*b* levers. Additionally, each lever 20*a* and 20*b* may be removed from its corresponding support bracket 30*a* and 30*b* by disengaging interior hinge rods 48*a* and 48*b*, respectively. Finally, the support brackets 30*a* and 30*b* themselves are designed such that they may be built (i.e., permanently incorporated) into the footwear during manufacture.

FIG. 4 shows that the posterior ends of each strap 10*a* and 10*b* form oval cylinders 33*a* and 33*b*, respectively, which fit into and are capable of sliding through a matching bore situated at the top of the left 20*a* and right 20*b* levers. This configuration maintains the orientation of the straps 10*a* and 10*b* with respect to levers 20*a* and 20*b* while still permitting the user to laterally adjust the position of straps 10*a* and 10*b* for improved conformity to the user's foot by sliding it forward or backwards. The straps 10*a* and 10*b* may each be secured into the desired position by means of locking screws 21*a* and 21*b* which are located on the outside of each strap, thereby enabling adjustment of the position of the straps. This is further illustrated by FIGS. 5A and 5B which are exterior and interior side views, respectively, of the fastening device 300.

Figure 5A:
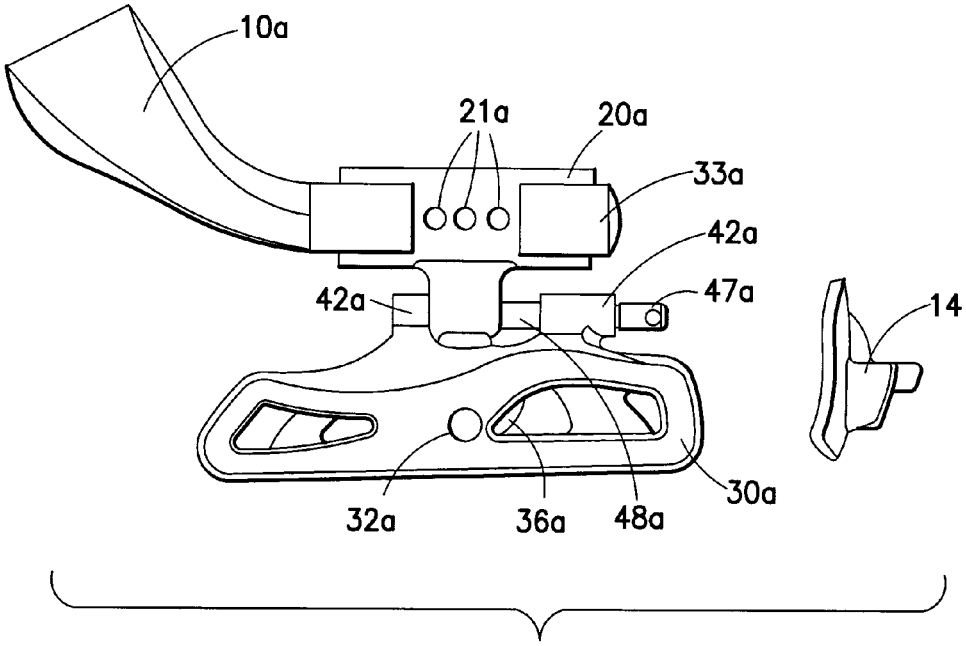
FIGS. 5A, 5B, 5C, and 5D are outside side, inside side, top, and front views of the third embodiment of the fastening device, respectively.
Figure 5B:
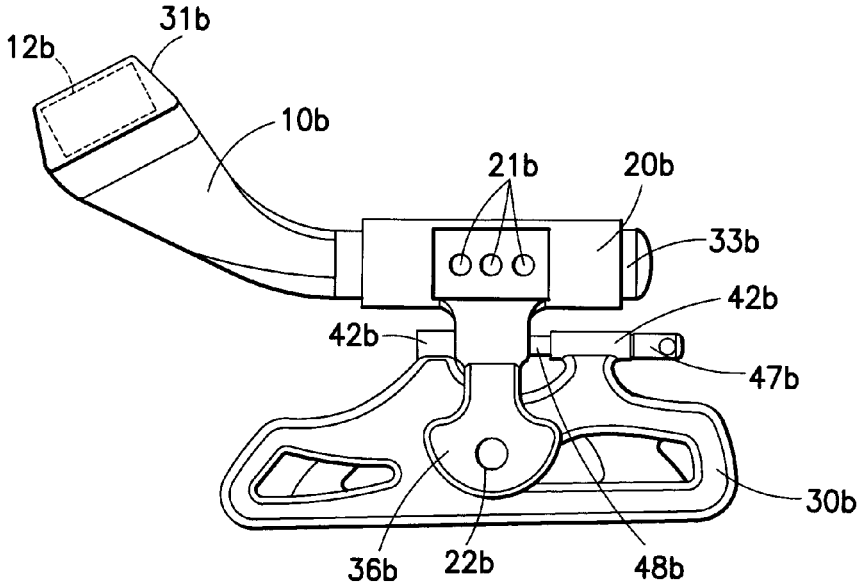
Figure 5C:
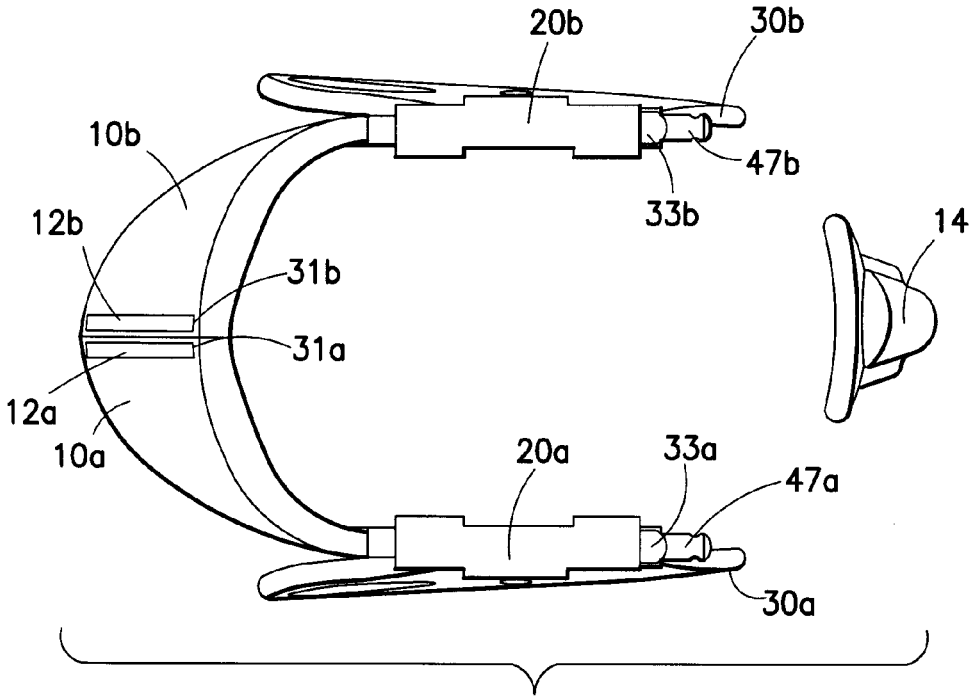
Figure 5D:
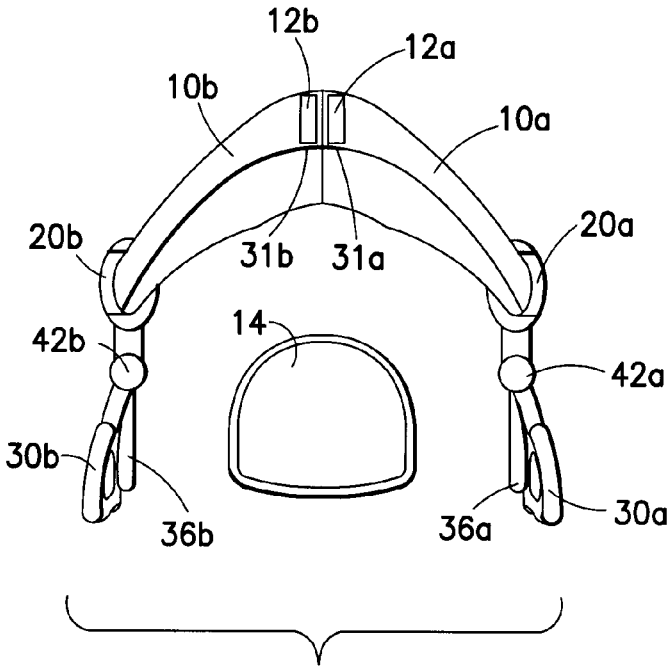
Figure 6:
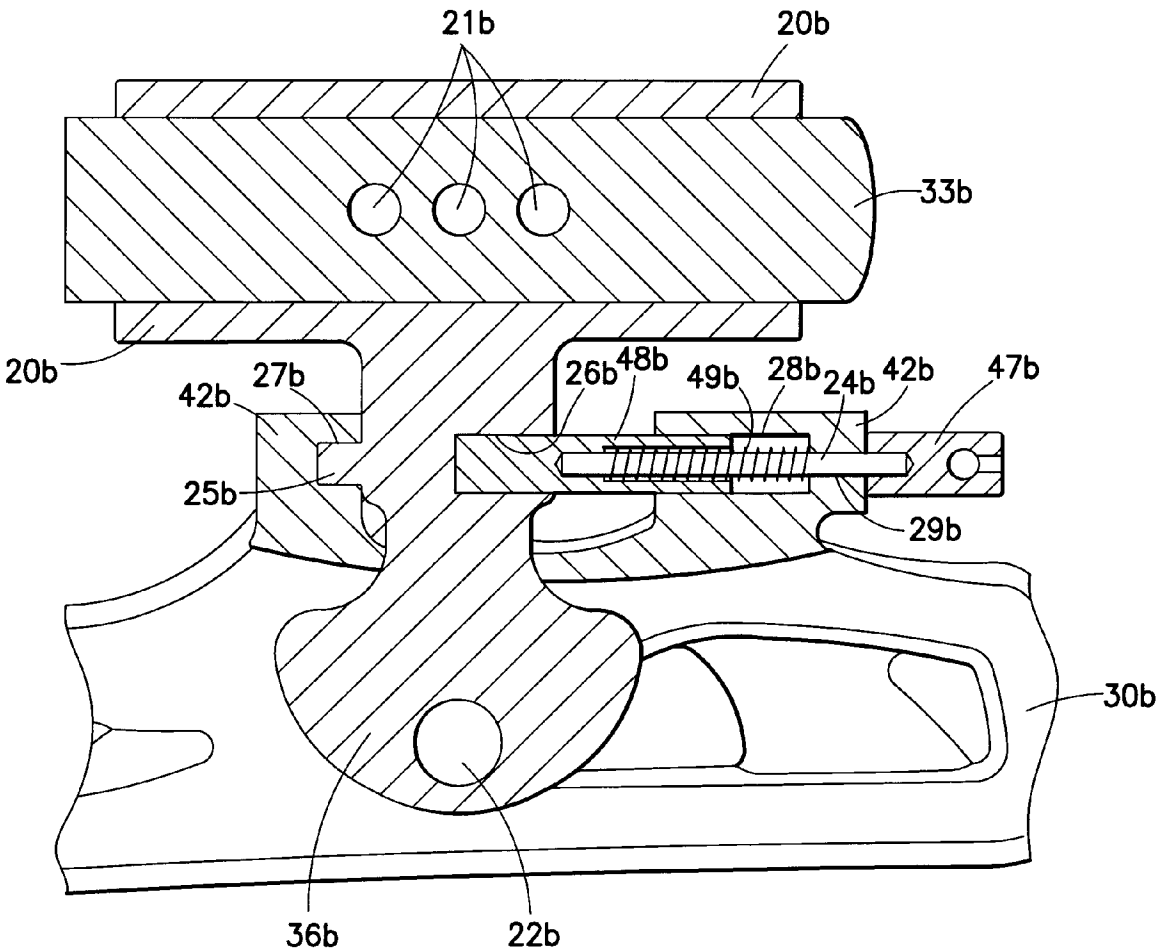
FIG. 6 shows the details of the hinge assembly used in the third embodiment.

As in the first embodiment, the distal ends of the straps 10*a* and 10*b* in the third embodiment comprise permanent magnets 12*a* and 12*b* which are oriented with opposite polarities on their mating sides. The magnets are held in place by means of pockets 31*a* and 31*b* which permit insertion and removal of magnets with differing strengths. In this manner the user is able to adjust the amount of force securing the straps in the closed position. Levers 20*a* and 20*b* are supplied with magnets 22*a* and 22*b* centrally located within crescent-shaped bottom segments 36*a* and 36*b* (see, e.g., FIG. 5B). Magnets 22*a* and 22*b* engage with corresponding magnets 32*a* and 32*b* (note that not all components are visible in FIGS. 4, 5A, 5B, 5C, and 5D) positioned on the left 30*a* and right 30*b* support brackets, respectively. Additional perspectives of the fastening mechanism 300 of the third embodiment are shown in FIGS. 5C and 5D which provide top and front views, respectively.

The levers 20*a* and 20*b* are each attached to its corresponding support bracket 30*a* and 30*b* at attachment points 42*a* and 42*b* by means of horizontally oriented interior hinge rods 48*a* and 48*b*. The hinge assembly permits each lever to rotate between an open and closed position. As is the case for the first embodiment, in the open position the crescent-shaped bottom segments 36*a* and 36*b* are aligned approximately perpendicular to support brackets 30*a* and 30*b* whereas in the closed position the crescent-shaped bottom segments 36*a* and 36*b* are approximately parallel to support brackets 30*a* and 30*b*. Furthermore, the straps 10*a* and 10*b* may be maintained in the open position when the magnets are not engaged by means of a suitably positioned elastic member or spring which connects the outside of each strap with the outside of a corresponding support bracket 30*a* or 30*b*.

A further distinction over the first embodiment is that each lever 20*a* and 20*b* may be removed from the support frame since interior hinge rods 48*a* and 48*b* are retractable. A cross-sectional schematic showing the details of the hinge assembly on the right support bracket 30*b* is provided in FIG. 6. Although not shown, an identical structure may be used on the left support bracket 30*a*. The hinge assembly comprises exterior 47*b* and interior 48*b* components which are secured to each other and attached to the support bracket 30*b* by a connecting shaft 24*b*. On one end, the interior hinge rod 48*b* is secured to the connecting shaft 24*b* which, in turn passes through hinge 29*b* before being secured to exterior hinge rod 47*b*. The inner hinge rod 48*b* is situated within a receiving bore 28*b* such that by grasping the outer hinge rod 47*b*, the user can slide the hinge rod from one end of the bore to the other.

A portion of the hinge assembly is formed on lever 20*b* as a protruding hinge member 25*b* and a hinge bore 26*b*. The lever 20*b* is secured to the support bracket 30*b* by first positioning the protruding hinge member 25*b* within a matching receiving bore 27*b* located at attachment point 42*b*. The lever 20*b* is then secured in place by inserting the interior hinge rod 48*b* into the hinge bore 26*b* located on the lever 20*b*. The interior hinge rod 48*b* is held against the lever 20*b* by means of a spring 49*b* located within the receiving bore 28*b*, between one end of the interior hinge rod 48*b* and the interior end of the receiving bore 28*b*. Thus, by grasping and pulling towards the rear of the shoe on the outer hinge rod 47*b*, the pressure exerted to hold the lever 20*b* in place is released and the lever 20*b* can be removed. Lever 20*b* can be reattached by performing the reverse of this process.

Figure 7A:
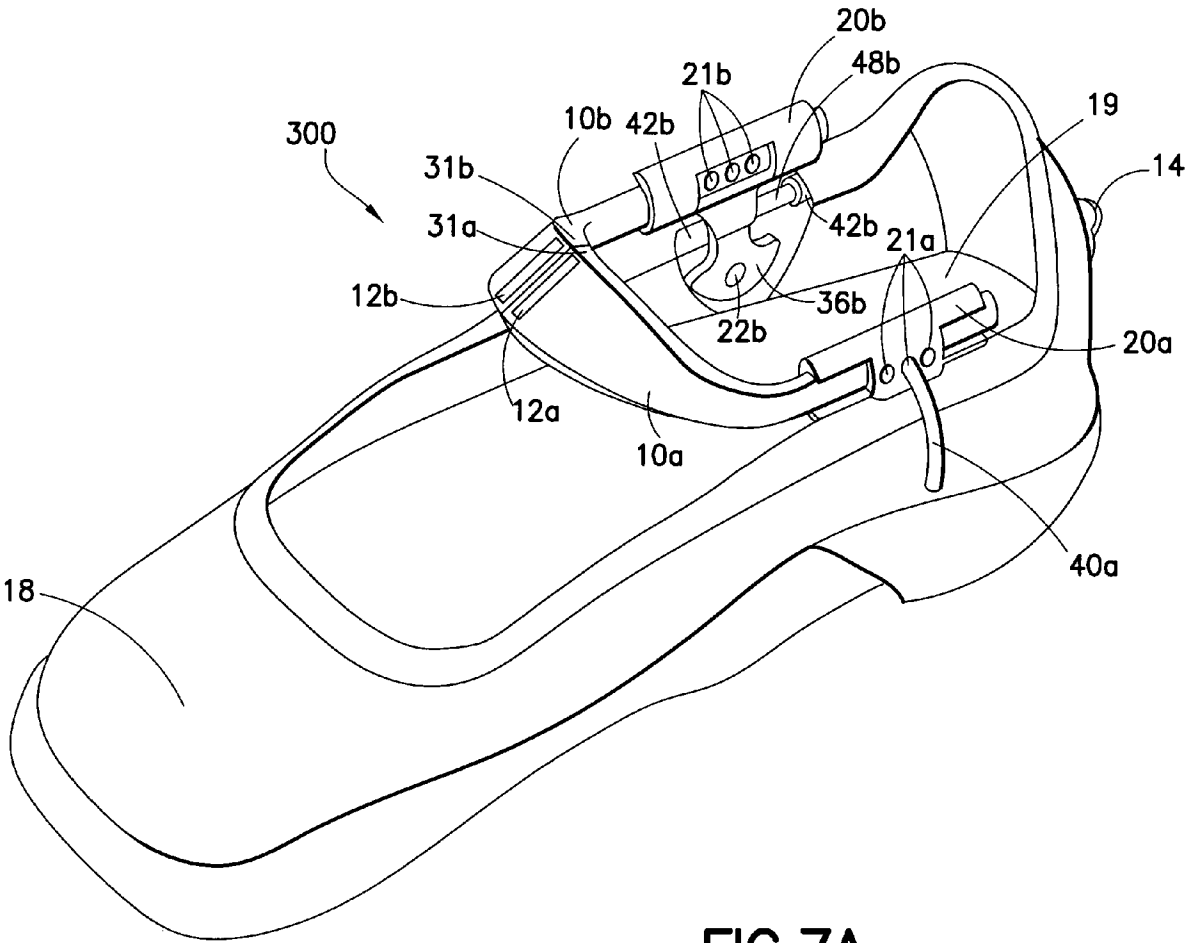
FIG. 7A is a schematic showing a perspective view of an actual shoe which incorporates the third embodiment of the fastening device.

The entire fastening mechanism 300 may be incorporated into the design and manufacture of nearly any type of footwear. An example is shown by FIG. 7A which is a schematic illustrating the implementation of the third embodiment of the fastening mechanism 300 within an article of footwear. The basic principles of operation are similar to, but not limited by those disclosed for the first embodiment with the additional features and advantages as discussed above.

Figure 7B:
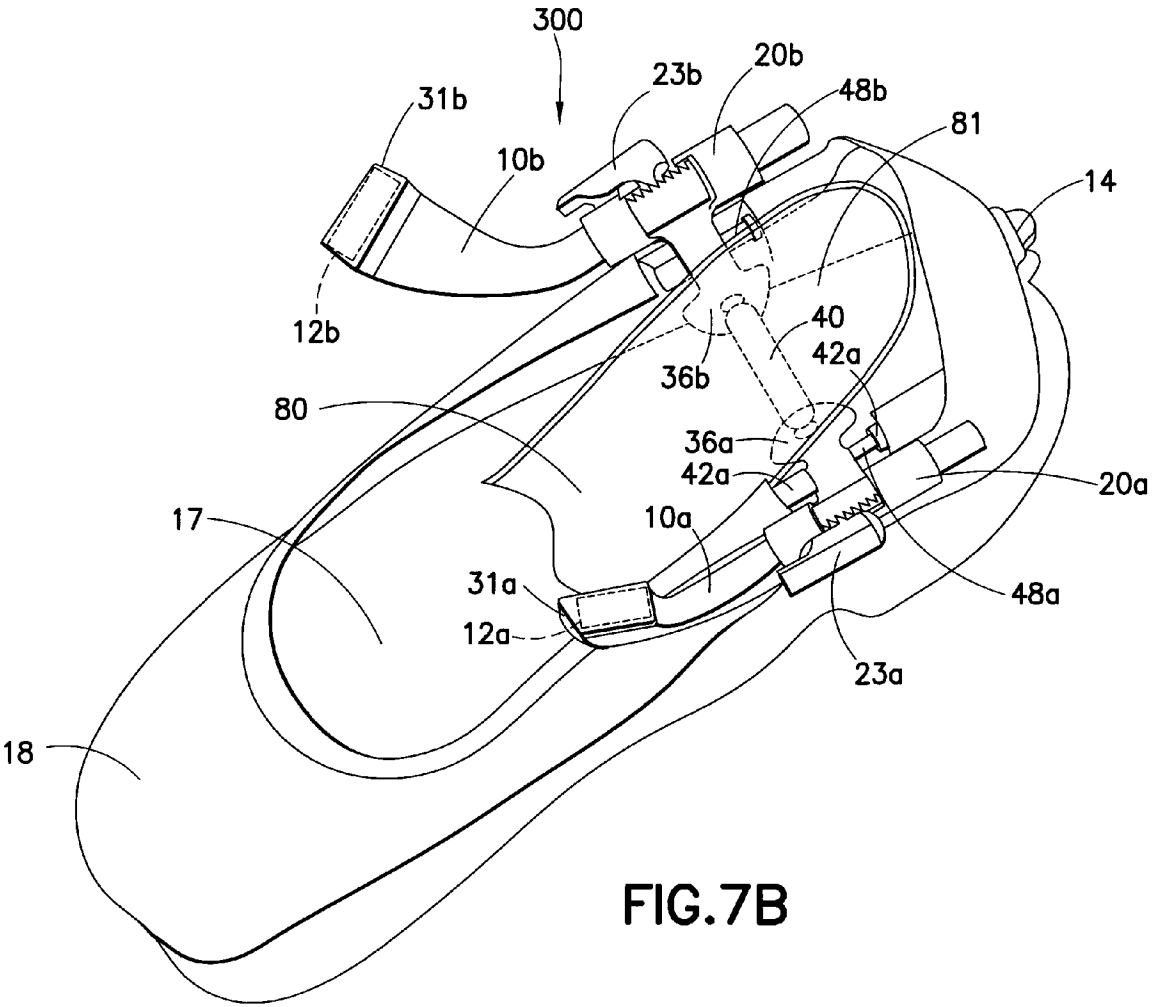
FIG. 7B is a schematic showing a perspective view of an actual shoe which incorporates the third embodiment of the fastening device with some alternative design features.

FIG. 7B depicts a front perspective view of a schematic illustrating the third embodiment with three alternative design features. The first design alternative introduces a flexible in-sole 80 as an additional element. The in-sole 80 is only attached to the main body of the shoe forward of the area of the arch 17 by any suitable means, such as adhesive. By doing so, a hinge point is thus created between the portion of in-sole 80 which is attached to the main body of the shoe and the portion that is not attached thereby enabling the heel portion of the in-sole 81 to rotate up and down. The heel portion of the in-sole 81 is positioned such that it is located above crescent-shaped bottom segments 36*a* and 36*b* when the device is in the open position.

With this modification, the operation of the fastening device 300 is altered as follows. The user slides his/her toes into the front end 18 and then brings the heel of the foot down towards the heel portion of the in-sole 81 such that it comes into contact with and engages crescent-shaped bottom segments 36*a* and 36*b*. Continued downward pressure causes levers 20*a* and 20*b* to move pivotally downwards about their respective interior hinge rods 48*a* and 48*b* while simultaneously elongating elastic member 40 and causing straps 10*a* and 10*b* to pivot upwards such that they engage and thereby secure the user's foot.

A second alternative design feature shown in FIG. 7B is the replacement of the locking screw (21*a* and 21*b*) arrangement for making adjustments to straps 10*a* and 10*b* with a ratchet and pawl arrangement as indicated in components 23*a* and 23*b* respectively, which allow for quick and easy forward and backward adjustment of the straps 10*a* and 10*b* by the user.

A third design alternative relates to the replacement of the elastic members 40*a* and 40*b*. In this embodiment, they are substituted by a single elastic member 40, which is attached between the two distal ends of crescent-shaped bottom segments 36*a* and 36*b* and stretches across the width of the shoe and underneath the in-sole 80 as the user steps down into the shoe. Also, as in the previously described embodiments, the elastic member 40 serves to maintain the fastening device 300 in the open position once the user removes his/her foot from the shoe.

Fourth Embodiment

A fourth embodiment of a fastening device 400 is depicted in FIGS. 8A-B and 9-11. The fourth embodiment operates according to principles analogous to those described for the first through third embodiments, but utilizes a different mechanism. For the sake of continuity, similar nomenclature will be used to identify parts in the fourth embodiment whose configuration and function are analogous to components identified in previous embodiments.

Figure 8A:
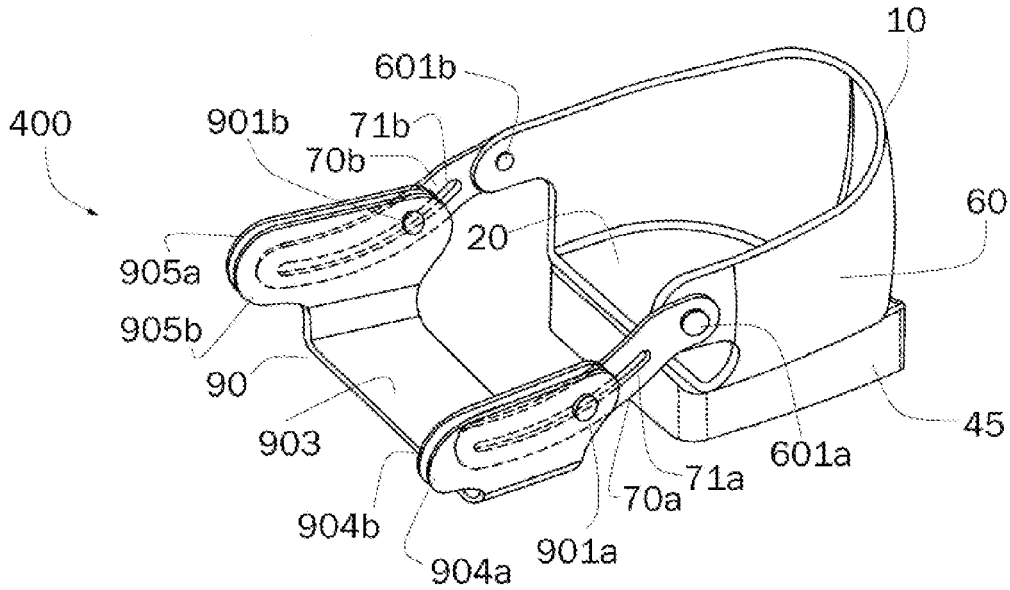
FIG. 8A is a perspective view of a fourth embodiment of the fastening device, shown in the closed position, which is designed to be built directly into the shoe during manufacture.
Figure 8B:
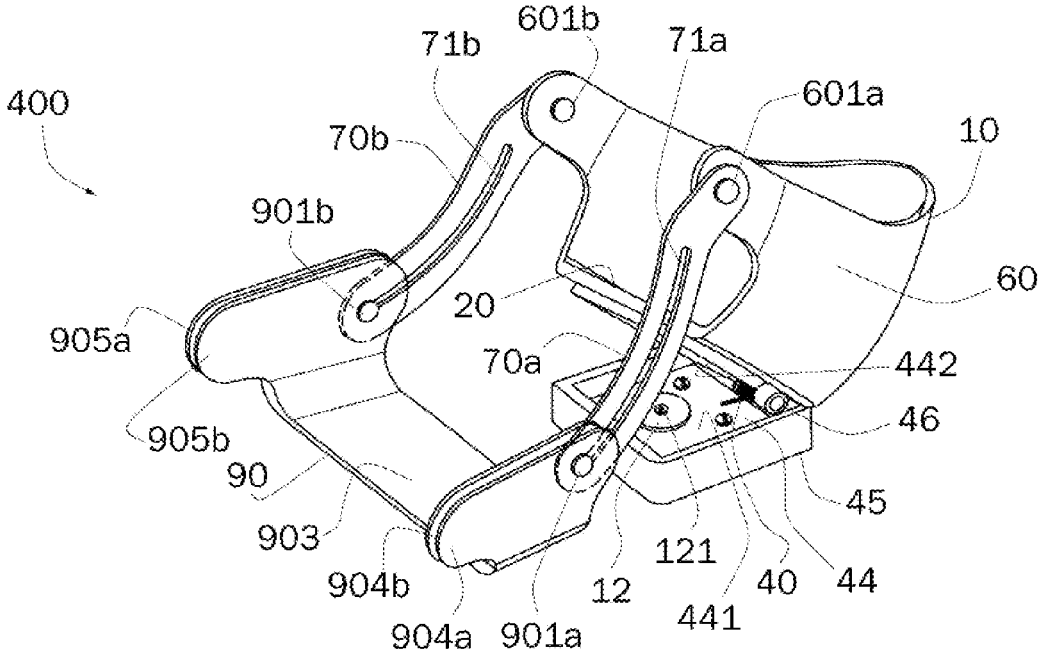
FIG. 8B is a perspective view of a fourth embodiment of the fastening device, shown in the open position, which is designed to be built directly into the shoe during manufacture.
Figure 9:
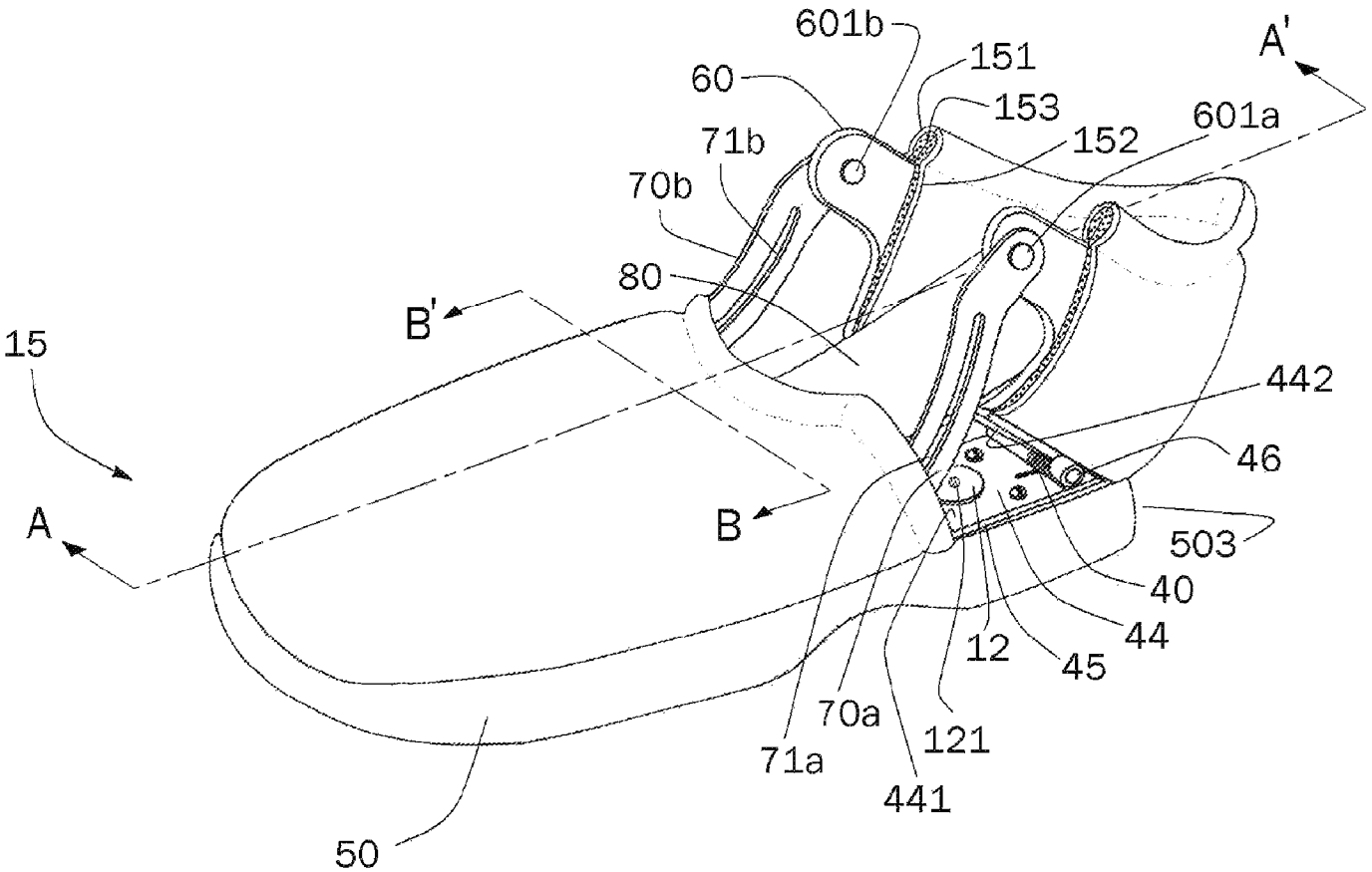
FIG. 9 shows a perspective view of an actual article of footwear, shown in the open position, which incorporates a fourth embodiment of the fastening device.
Figure 10:
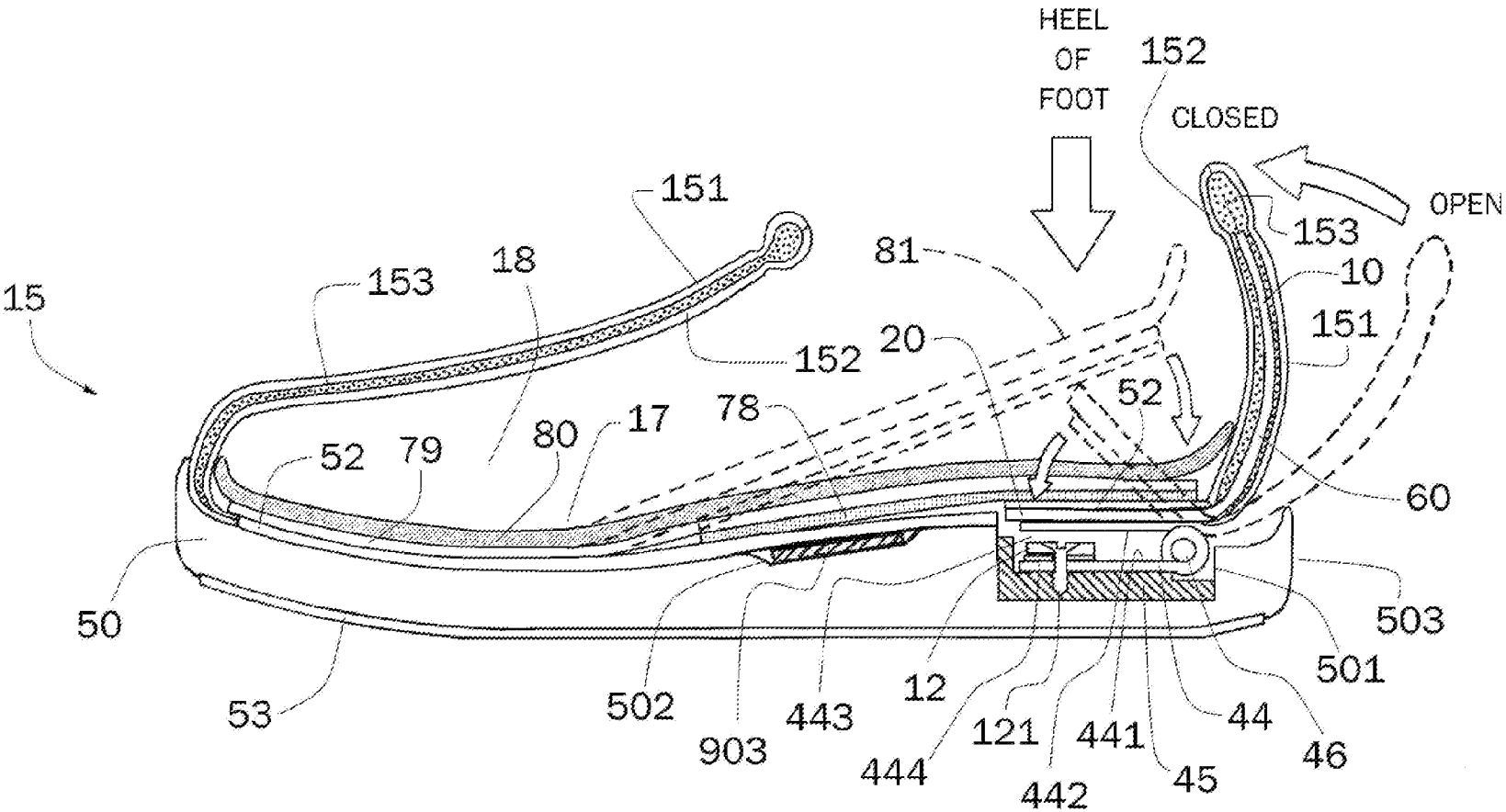
FIG. 10 is a cross-sectional schematic obtained along section A-A' in FIG. 9 which shows a side view of a fourth embodiment of the fastening device which illustrates the main components, their integration into the construction of an article of footwear, and illustrates the basic mode of operation.
Figure 11:
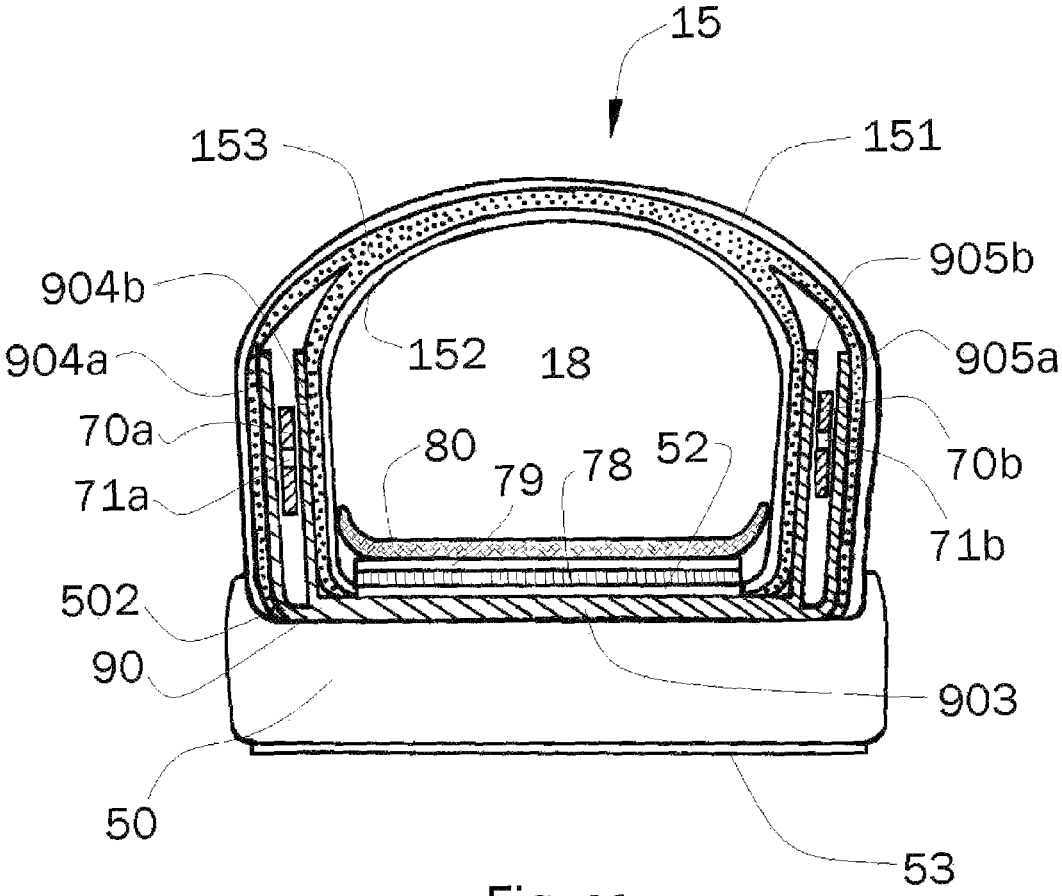
FIG. 11 is a cross-sectional schematic obtained along section B-B' in FIG. 9 which shows a rear view of a fourth embodiment of the fastening device which illustrates how a guide is incorporated into the construction of an article of footwear.
Figure 12:
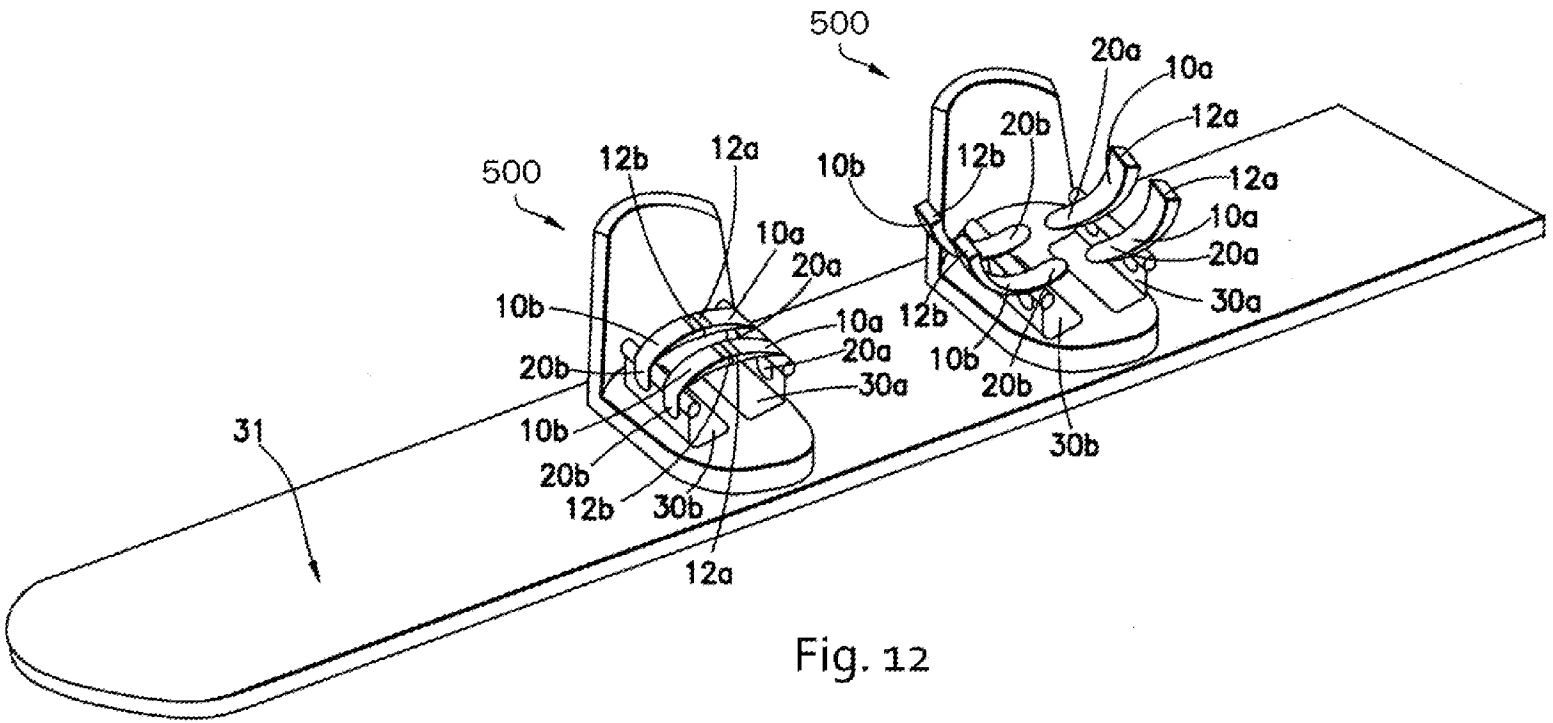
FIG. 12 is a sketch of the frontal perspective view of an embodiment of the fastening device utilized as a binding on a snowboard.

FIG. 8A is a schematic showing a side perspective view of a fourth embodiment of a fastening device 400 in the closed position whereas FIG. 8B is a side perspective view of the same fastening device 400 in the open position. FIG. 9 shows a perspective view of an actual article of footwear 15 which incorporates a fourth embodiment of the fastening device 400 whereas FIGS. 10 and 11 show cross-sectional schematics of the footwear 15 in FIG. 9 obtained along lines A-A' and B-B', respectively. The fastening device 400 comprises a heel cup 10 which is positioned to the rear of the user's foot such that it surrounds and cradles the heel and secures snugly behind the Achilles tendon of the foot. Heel cup 10 is coupled to heel base 20 with both the heel cup 10 and heel base 20 being integral portions of a heel enclosure 60. In this embodiment, the function of the heel cup 10 is analogous to the function of the straps (e.g., 10*a* and 10*b*), whereas the function of the heel base 20 is analogous to the function of the levers (e.g., 20*a* and 20*b*) which are described above in the first through third embodiments. Heel base 20, which forms the base portion of heel enclosure 60, is secured to hinge mount 45 by means of hinge 44.

In a particular embodiment, the hinge 44 has a bottom hinge leaf 441 which is fastened to hinge mount 45 by any means which is well-known in the art such as with an adhesive or by mechanical fasteners such as screws or rivets. Similarly, hinge 44 has a top hinge leaf 442 which is fastened to heel base 20. In this embodiment, when the fastening device 400 is in the closed position, the basal planes of the bottom hinge leaf 441 and top hinge leaf 442 are approximately parallel to each other. Hinge mount 45 is placed inside a molded cavity 501 provided within mid-sole 50 and is affixed within the molded cavity 501 with an adhesive or by means of mechanical fasteners (not shown). The heel enclosure 60 is configured to rotate about hinge rod 46 when a force is applied to heel base 20. In a particular embodiment, hinge rod 46 is oriented such that its rotational axis is approximately parallel with the top surface plane of hinge mount 45.

When in the closed position (see, e.g., FIGS. 8A and 10), the plane of heel base 20 is approximately parallel with the plane formed by the top surface of hinge mount 45 whereas in the open position (see, e.g., FIGS. 8B and 10), the plane of heel base 20 is at an angle of approximately 45 degrees with respect to the plane formed by the top surface of hinge mount 45. Furthermore, when in the closed position, the plane of heel base 20, as well as the basal planes of bottom hinge leaf 441, and top hinge leaf 442 are all approximately parallel with each other.

In one embodiment, hinge 44 may be fabricated out of a ferrous metal, but is not so limited. The inclusion of one or more magnets will subject such ferrous metals to a magnetic attractive force when brought into close proximity with each other. Accordingly, hinge 44 may be equipped with a permanent magnet 12 which is releasably affixed to at least one of the hinge leaves 441 or 442 by a suitable mechanical fastener such as a screw 121. In this manner, when in the closed position, the permanent magnet 12 will exert an attractive force on the opposing hinge leaf 441 or 442 thereby acting as a latch which releasably secures the fastening device 400 in the closed position. In another embodiment the permanent magnet 12 may be removable such that it can be replaced with magnets having varying strengths. In yet another embodiment a permanent magnet 12 may be provided on both the top hinge leaf 442 and bottom hinge leaf 441 with opposing polarities.

When the permanent magnet 12 is disengaged from an opposing hinge leaf or magnet, heel cup 10 may be maintained in the open position by means of, for example, a torsion spring 40 located within hinge 44 and about hinge rod 46. The rotational force provided by torsion spring 40 is such that when the permanent magnet 12 is disengaged, it is sufficient to push top hinge leaf 442 apart from bottom hinge leaf 441 and maintain the heel cup 10, heel base 20, and therefore the heel enclosure 60 in an open position. In alternate embodiments, other spring mechanisms which are known in the art may be used to maintain the heel enclosure 60 in an open position. One possibility includes the use of a retractable clip or elastic member which springs back to its original shape once an applied force has been removed.

In order to limit the open position of heel enclosure 60 to a desired angular rotation, which in this example is approximately 45 degrees, left and right connectors 70*a* and 70*b* may be attached to the left and right sides of heel enclosure 60 at points 601*a* and 601*b*, respectively, by means of, for example, a rivet, screw, or binding post. The left and right connectors 70*a* and 70*b* are attached in a manner which permits rotational movement about points 601*a* and 601*b*, respectively. The opposing ends of connectors 70*a* and 70*b* are attached in a similar fashion to guide 90 at points 901*a* and 901*b*, respectively, via left and right slots 71*a* and 71*b*. Referring to FIG. 11, in one embodiment guide 90 is U-shaped and is comprised of a base 903 with left uprights 904*a* and 904*b* and right uprights 905*a* and 905*b*. By attaching connectors 70*a* and 70*b* within the devises formed by the left uprights 904*a* and 904*b* and right uprights 905*a* and 905*b*, respectively, the connectors 70*a* and 70*b* also function to guide heel enclosure 60 into alignment with the front end 18 of footwear 15 as it moves from an open to a closed position.

In a particular embodiment, base 903 is placed inside a molded cavity 502 provided in mid-sole 50 and is affixed within the molded cavity 502 with an adhesive or by means of mechanical fasteners (not shown). The guide 90 itself may be embedded in the upper of footwear 15 as shown, for example, in FIG. 11. The upper of footwear 15 may be fashioned using standard footwear construction methods which are well-known in the art. In one embodiment, as shown in FIGS. 10 and 11, the upper comprises an outer covering layer 151, an inner lining layer 152, and a cushioning layer 153 which is sandwiched between the outer covering layer 151 and inner lining layer 152. It is to be understood, however, that the upper is not limited to the structure shown and described; any type of upper or footwear 15 which is well-known in the art may be used.

The left (904*a* and 904*b*) and right (905*a* and 905*b*) uprights also function to prevent connectors 70*a* and 70*b* from rubbing against the inside surfaces of the shoe upper (i.e., against cushioning layer 153) and to provide support and stabilization for the wearer's foot. Slots 71*a* and 71*b* in connectors 70*a* and 70*b*, respectively, provide attachment points to guide 90 at points 901*a* and 901*b*, respectively. The length of slots 71*a* and 71*b* determines how many degrees heel cup 60 may rotate open. In a particular embodiment, the base 903 of guide 90 is affixed between the mid-sole 50 and inner sole 52.

It is to be understood that the type of material used to fabricate the various components which constitute the fastening device 400 illustrated in FIGS. 8A-B is not limited to any particular material. Rather, any material which is well-known in the art may be used so long as it provides the requisite material properties and other characteristics necessary for each component to operate according to its intended function. In some embodiments components such as the heel cup 10, heel base 20, hinge mount 45, guide 90, and connectors 70*a* and 70*b* may be fabricated from one or more materials which include, but are not limited to metals or metal alloys, various types of plastics, polymers, and/or composite materials such as fiberglass or carbon fiber.

As described above with reference to the third embodiment, the fastening device 400 in the fourth embodiment may use a flexible in-sole 80 to actuate heel base 20. However, in this embodiment a number of additional features are included to improve performance and comfort. Referring to FIG. 10, the in-sole may, for example, be permanently affixed, releasably affixed, or simply placed on top of a foam layer 79. In a particular embodiment, the foam layer 79 has substantially the same footprint (i.e., the same contour) as the in-sole 80 and serves to provide additional cushioning to the user. Furthermore, as is the case for the in-sole 80 described in the third embodiment, the foam layer 79 is secured to the main body of the footwear 15 only in a region which is located forward of the arch 17. Attachment may be accomplished using any suitable means, but in a particular embodiment is via an adhesive.

In another embodiment a semi-rigid board layer 78 is affixed to the underside of foam layer 79 by any suitable means such as, for example, through the use of an adhesive. The semi-rigid board layer 78 may be fabricated from, for example, a fiber board or any other suitable material and serves to provide a thin, yet semi-rigid surface. In a particular embodiment, the width of the semi-rigid board layer 78 is approximately the same as that of foam layer 79 and the length of the semi-rigid board layer 78 extends from approximately the rear of foam layer 79 to a position adjacent to where the foam layer 79 is affixed to inner sole 52 as shown, for example, in FIG. 10. When utilized together, the in-sole 80, foam layer 79, and semi-rigid board layer 78 provide increased comfort to the user and serve to maintain the dimensional integrity (i.e., minimize crimping and flexion) of the in-sole 80 upon insertion of the user's foot into footwear 15.

It is to be understood that the type, kind, and number of layers (such as, for example, components 78, 79, and 80) used in the construction of an article of footwear 15 utilizing fastening device 400 may vary depending on the manufacturer and needs of the targeted consumer. For example, a plurality of coverings, layers, and/or soles may be added, eliminated or combined and their sequence may be altered. Such variations are to be considered within the scope of the invention disclosed in this specification.

Referring to FIGS. 9 and 10, a mode of operating the fastening device 400 is described as follows. Initially, the user slides his/her toes into the front end 18 of footwear 15 and then brings the heel of the foot down towards the heel portion 81 of in-sole 80. Continued downward motion transmits downward pressure from the user's foot through the heel portion 81 of in-sole 80 to foam layer 79 and then through semi-rigid board layer 78 such that the semi-rigid board layer 78 comes into contact with and engages the front edge portion of the heel enclosure 60. Continued downward pressure causes heel base 20 and thus top hinge leaf 442 to move pivotally downwards about hinge rod 46 while simultaneously tensioning torsion spring 40 and causing heel cup 10 to pivot upwards and inwards such that top hinge leaf 442 engages with permanent magnet 12 and heel cup 10, thereby secures the user's foot inside footwear 15.

The fastening device 400 may, in one embodiment, be disengaged by performing the following steps. The wearer, from either a standing or sitting position, simply strikes midsole 50 in the heel area 503 and above out-sole 53 in a downward and rearward motion against the ground or other hard surface with sufficient force so as to break the magnetic holding force of magnet 12 with top hinge leaf 442. As shown by the dotted lines in FIG. 10, with the magnetic holding force broken, heel enclosure 60 will rotate in a clockwise direction about hinge rod 46 such that heel cup 10 is tilted backward, thereby allowing the wearer's foot, with continued downward and rearward motion, to exit the rear of footwear 15. As explained above, once the permanent magnet 12 has been disengaged from an opposing hinge leaf or magnet, torsion spring 40 will maintain footwear 15 in the open position ready to receive the user's foot for the next wearing.

It is an objective of this embodiment to be able to adjust the holding strength of fastening device 400 since the physical abilities of the user will vary. In this configuration, two exemplary approaches to adjusting the holding strength of the device will be described. One, as in the previous embodiments, is to substitute permanent magnet 12 with another having a different magnetic strength. The second method is to adjust the distance of the permanent magnet 12 in relation to the opposing hinge leaf thereby changing the gap distance 443. Doing so will affect a corresponding change in the attractive pull force exerted by the permanent magnet 12 against the opposing hinge leaf and therefore in the holding strength of fastening device 400. An exemplary method of adjusting the gap distance 443 involves adding one or more shims, such as washer 444, between permanent magnet 12 and bottom hinge leaf 441 as shown, for example, in FIG. 10. The effect of doing so is to decrease the gap distance 443 which will cause an increase in the magnetic attractive force on opposing top hinge leaf 442 and thus, an increase in the securing strength of fastening device 400.

It is to be understood that a number of variations may be made to the embodiment shown and described with reference to FIGS. 8A-B and 9-11 without deviating from the spirit and scope of this embodiment. For example, it is conceivable that an alternate sliding and/or locking mechanism may be used in place of the left and right connectors 70*a* and 70*b* which is capable of performing a similar function using a different mechanism. In another exemplary embodiment the fastening device 400 may be comprised of a heel enclosure 60 which does not have left and right connectors 70*a* and 70*b*. In this embodiment the heel enclosure 60 is able to freely swing between an open and closed position, being constrained only by hinge 44.

Additional Application

An application which further exemplifies the advantages inherent to a user of the fastening device will now be described. This application involves the utilization of the fastening mechanism with foot bindings on a snowboard 31. An illustrative example of such an application is provided in FIG. 12. Here, two fastening mechanisms 500 of a type analogous to those disclosed in the above embodiments are used for each foot. By utilizing multiple fastening mechanisms, additional reinforcement is supplied to each foot to ensure that each is firmly secured to the snowboard 31.

The fastening mechanism itself may be attached to the snowboard by any suitable means (e.g., bolted down or attached via screws) and operates using the same principles as disclosed for the first through third embodiments. Thus, the user may individually secure each foot to the snowboard by applying a downward stepping motion which engages levers 20*a* and 20*b*, thereby rotating the straps 10*a* and 10*b* together such that they engage and thereby secure the user's foot. However, the method of release is slightly different since, each foot is immobile when secured to the snowboard.

The user's foot can be removed from the apparatus by applying a downward force with one foot to immobilize the snowboard while simultaneously lifting up on the opposite foot such that the magnets are disengaged. The released foot can then be placed on any surface of the snowboard to immobilize the snowboard while simultaneously lifting up on the other foot to disengage the magnets, thereby permitting the user to remove the other foot from the snowboard. In this manner the user is able to quickly and easily secure and release each foot with the foot bindings via hands-free operation.

It will be appreciated by persons skilled in the art that the present disclosure is not limited to what has been particularly shown and described hereinabove. Rather, the scope of the present disclosure is defined by the claims which follow. It should further be understood that the above description is only representative of illustrative examples of embodiments. For the reader's convenience, the above description has focused on a representative sample of possible embodiments, a sample that teaches the principles of the present disclosure. Other embodiments may result from a different combination of portions of different embodiments.

The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent.

What is claimed is:

1. A fastening device configured for use with an article of footwear comprising:

a pivotally movable heel enclosure comprising a heel cup which is configured to surround a heel and secure behind an Achilles tendon of a foot, and a heel base which is coupled to the heel cup and is engageable by a part of a foot so as to cause the heel enclosure to move from an open position to a closed position when engaged by the part of the foot;

a guide having a pair of uprights; and a pair of connectors, each of which is coupled to one of the uprights and to a side of the heel cup and are each configured to guide the heel enclosure between the open position and the closed position, wherein each connector is coupled to the respective upright such that during movement of the heel enclosure between the open and closed positions, the connector is driven along a predetermined path, while the coupling between the connectors and the respective uprights and the coupling between the connectors and the heel cup are maintained.

2. The fastening device according to claim 1 wherein the pivotally movable heel enclosure is affixed to a hinge mount by means of a hinge which is configured to allow the heel enclosure to move between the open position and the closed position.

3. The fastening device according to claim 2 wherein the hinge comprises at least one catch which, when engaged, will maintain the heel enclosure in the closed position and, when disengaged, will permit the heel enclosure to rotate to the open position.

4. The fastening device according to claim 3 wherein the heel enclosure is maintained in the open position by means of a torsion spring.

5. The fastening device according to claim 3 wherein the catch is at least one of a permanent magnet or a mechanical interlocking device.

6. The fastening device according to claim 5 wherein the catch comprises a removable permanent magnet.

7. The fastening device according to claim 5 wherein the catch comprises a permanent magnet and an attractive force of the permanent magnet is adjusted by changing the gap distance between opposing hinge leaves of the hinge.

8. The fastening device according to claim 7 wherein the gap distance is changed by means of a shim or a washer.

9. The fastening device according to claim 1 wherein each upright comprises a clevis which permits the connector coupled to each upright to slide through their respective clevis along the predetermined path in a longitudinal direction with respect to the respective upright.

10. The fastening device according to claim 9 wherein each connector comprises an elongated slot that is formed along a length of the connector, the connector being slidably attached to the respective upright by means of an attachment member which passes through its respective slot.

11. The fastening device according to claim 10, wherein the elongated slot has a curved shape.

12. The fastening device according to claim 1, wherein in both the open and closed positions, an end of the connector that is coupled to the heel cup is at an elevated height relative to an opposite end of the connector that is coupled to the upright.

13. An article of footwear comprising:

a sole;

a pivotally movable heel enclosure comprising a heel cup which is configured to surround a heel and secure behind an Achilles tendon of a foot, and a heel base which is coupled to the heel cup and is engageable by a part of a foot so as to cause the heel enclosure to move from an open position to a closed position when engaged by the part of the foot;

a hinge which is coupled to the heel enclosure to allow the heel enclosure to move between the open position and the closed position;

a guide having a pair of uprights; and a pair of connectors, each of which is coupled to one of the uprights and to a side of the heel cup and are each configured to guide the heel enclosure between an open position and a closed position, wherein the coupling between the connectors and the respective uprights is of a type such that during movement of the heel enclosure between the open and closed positions, the connectors are controllably driven along a predetermined path, while the coupling between the connectors and the respective uprights and the coupling between the connectors and the heel cup are maintained.

14. The article of footwear according to claim 13 wherein the hinge is affixed to a hinge mount.

15. The fastening device according to claim 14 wherein the heel cup has a generally U-shaped side wall that extends upwardly from the heel base, each connector being connected to the U-shaped side wall at a location that is above the heel base on which the part of the foot engages in order to move the heel enclosure between the open position and closed position.

16. The article of footwear according to claim 14 wherein the hinge mount is provided within a first cavity in the sole.

17. The article of footwear according to claim 13 wherein the hinge comprises at least one catch which, when engaged, will maintain the heel enclosure in the closed position and, when disengaged, will permit the heel enclosure to rotate to the open position.

18. The article of footwear according to claim 17 wherein the heel enclosure is maintained in the open position by means of a torsion spring.

19. The article of footwear according to claim 17 wherein the catch is at least one of a permanent magnet or a mechanical interlocking device.

20. The article of footwear according to claim 13 wherein the guide is provided within a second cavity in the sole and the uprights are embedded within an upper of the footwear.

21. The article of footwear according to claim 20 wherein each upright comprises a clevis which permits the connector coupled to each upright to slide through their respective clevis along the predetermined path in a longitudinal direction with respect to the respective upright.

22. The article of footwear according to claim 21 wherein each connector has an elongated slot formed therein and is slidably attached within the clevis of its respective upright by means of an attachment member which passes through its respective elongated slot, thereby permitting the connectors to move longitudinally relative to the respective uprights.

23. The article of footwear according to claim 13 further comprising a flexible in-sole positioned to engage the heel base.

24. The article of footwear according to claim 23 wherein the in-sole comprises a semi-rigid board layer affixed to an underside of the in-sole in a region where the in-sole engages the heel base.

25. A foot fastening device configured for use with an article of footwear comprising:

a pivotally movable strap which is configured to surround a heel and secure behind an Achilles tendon of a foot, and a lever which is coupled to the strap and is engageable by a part of a foot so as to cause the strap to move from an open position to a closed position when engaged by the part of the foot;

a guide having a pair of uprights; and a pair of connectors, each of which is coupled to one of the uprights and to a side of the strap and are each configured to guide the heel enclosure between the open position and the closed position, wherein each connector is coupled to the respective upright such that during movement of the heel enclosure between the open and closed positions, the connector is driven along a predetermined path, while the coupling between the connectors and the respective uprights and the coupling between the connectors and the strap are maintained.

26. The foot fastening device according to claim 25 wherein the strap and lever are affixed to a hinge mount by means of a hinge which is configured to allow the strap to move between the open position and the closed position.

27. The fastening device according to claim 26 wherein the hinge comprises at least one catch which, when engaged, will maintain the strap in the closed position and, when disengaged, will permit the strap to rotate to the open position.

28. The fastening device according to claim 24 wherein the catch is at least one of a permanent magnet or a mechanical interlocking device.

29. The fastening device according to claim 28 wherein the catch comprises a removable permanent magnet.

30. The fastening device according to claim 25 wherein each upright comprises a clevis which permits the connector coupled to each upright to slide through their respective clevis along the predetermined path in a longitudinal direction with respect to the respective upright.

31. The fastening device according to claim 30 wherein each connector has an elongated slot formed therein and is slidably attached within the clevis of its respective upright by means of an attachment member which passes through its respective elongated slot, wherein in the open position, the attachment member is disposed at a first location within the elongated slot and in the closed position, the attachment member is disposed at a different second location within the elongated slot.

32. The fastening device according to claim 31, wherein the attachment member is formed at a fixed location with respect to the upright.

* * * * *